US010759645B2

(12) United States Patent
Aslam et al.

(10) Patent No.: US 10,759,645 B2
(45) Date of Patent: Sep. 1, 2020

(54) INSERTS AND NOZZLE ASSEMBLIES FOR BEVERAGE DISPENSERS

(71) Applicant: Cornelius, Inc., Osseo, MN (US)

(72) Inventors: Arsalan Aslam, Bloomingdale, IL (US); Sandesh Aravinda, Carol Stream, IL (US); Kurt Zoellick, Oak Park, IL (US); Christopher F. Zemko, Elgin, IL (US)

(73) Assignee: Cornelius, Inc., Osseo, MN (US)

( * ) Notice: Subject to any disclaimer, the term of this patent is extended or adjusted under 35 U.S.C. 154(b) by 0 days.

(21) Appl. No.: 16/050,786

(22) Filed: Jul. 31, 2018

(65) Prior Publication Data

US 2019/0039873 A1 Feb. 7, 2019

Related U.S. Application Data

(60) Provisional application No. 62/539,694, filed on Aug. 1, 2017.

(51) Int. Cl.
*B67D 1/00* (2006.01)

(52) U.S. Cl.
CPC ..... *B67D 1/005* (2013.01); *B67D 1/0021* (2013.01); *B67D 1/0048* (2013.01); *B67D 2210/00031* (2013.01)

(58) Field of Classification Search
CPC .... B67D 1/005; B67D 1/0021; B67D 1/0048; B67D 2210/00031
USPC ..... 222/129.1–129.4, 330, 331, 566
See application file for complete search history.

(56) References Cited

U.S. PATENT DOCUMENTS 2,620,108 A * 12/1952 Copping ..... B67D 1/0044 222/133
3,575,352 A * 4/1971 Hall ..... B01F 5/0451 239/434.5
4,509,690 A 4/1985 Austin et al.
4,986,447 A * 1/1991 McCann ..... B67D 1/0044 222/129.1
5,048,726 A * 9/1991 McCann ..... B67D 1/0044 222/129.1
5,203,474 A * 4/1993 Haynes ..... B67D 1/0044 222/129.1
5,269,442 A 12/1993 Vogel
(Continued)

OTHER PUBLICATIONS

International Search Report and Written Opinion, PCT/US2018/044773, dated Oct. 16, 2018.

*Primary Examiner* — Vishal Pancholi
(74) *Attorney, Agent, or Firm* — Andrus Intellectual Property Law, LLP

(57) ABSTRACT

An insert for use with a beverage dispenser includes a diffuser having an upstream end configured to receive the first base fluid, a downstream end with an outlet configured to dispense the first base fluid, and a center bore extending between the upstream end and the downstream end along an axis. A stem is disposed in the center bore of the diffuser and has a first end configured to receive a second base fluid and an opposite second end with an outlet configured to dispense the second base fluid. The outlet of the diffuser is upstream from the outlet of the stem such that the first base fluid dispensed from the outlet of the diffuser mixes with an additive fluid before the second base fluid dispensed from the outlet of the stem mixes with the additive fluid.

9 Claims, 21 Drawing Sheets

(56) References Cited

U.S. PATENT DOCUMENTS

| | | | | |
|---|---|---|---|---|
| 5,415,326 | A * | 5/1995 | Durham | B67D 1/005 222/129.1 |
| 6,047,859 | A * | 4/2000 | Schroeder | B67D 1/0043 222/1 |
| 6,223,948 | B1 * | 5/2001 | Davis | B67D 1/0021 222/129.1 |
| 6,253,963 | B1 * | 7/2001 | Tachibana | B67D 1/0044 222/129.1 |
| 7,070,068 | B2 * | 7/2006 | Fox | B67D 1/0021 222/129.1 |
| 7,108,156 | B2 * | 9/2006 | Fox | B67D 1/0021 222/129.1 |
| 7,383,966 | B2 | 6/2008 | Ziesel | |
| 7,445,133 | B2 * | 11/2008 | Ludovissie | B67D 1/0021 222/129.1 |
| 7,487,887 | B2 | 2/2009 | Ziesel | |
| 7,578,415 | B2 | 8/2009 | Ziesel et al. | |
| 7,665,632 | B2 | 2/2010 | Ziesel | |
| 7,866,509 | B2 | 1/2011 | Ziesel | |
| 8,047,402 | B2 | 11/2011 | Ziesel | |
| 8,091,737 | B2 | 1/2012 | Smeller et al. | |
| 8,162,177 | B2 | 4/2012 | Ziesel | |
| 8,328,050 | B2 | 12/2012 | Ziesel | |
| 8,453,879 | B2 | 6/2013 | Carpenter et al. | |
| 8,820,580 | B2 * | 9/2014 | Ziesel | B67D 1/0044 222/129.1 |
| 9,010,577 | B2 | 4/2015 | Hoover | |
| 9,656,849 | B2 | 5/2017 | Hawken | |
| 2005/0045655 | A1 | 3/2005 | Santy, Jr. | |
| 2013/0200103 | A1 | 8/2013 | Gates | |
| 2014/0361041 | A1 * | 12/2014 | Hawken | B67D 1/0085 222/129.1 |
| 2015/0315006 | A1 | 11/2015 | Ziesel | |
| 2016/0009539 | A1 | 1/2016 | Jersey et al. | |
| 2018/0162710 | A1 | 6/2018 | Moore et al. | |

* cited by examiner

INSERTS AND NOZZLE ASSEMBLIES FOR BEVERAGE DISPENSERS

CROSS-REFERENCE TO RELATED APPLICATION

The present application is based on and claims priority to U.S. Provisional Patent Application Ser. No. 62/539,694 filed Aug. 1, 2017, the disclosure of which is incorporated herein by reference

FIELD

The present disclosure relates beverage dispensers and specifically relates to inserts and nozzle assemblies for use with beverage dispensers.

BACKGROUND

Beverage dispensers are commonly used to dispense post-mixed beverages to employees and customers. Conventional beverage dispensers include at least one dispensing nozzle from which base fluids, such as high fructose corn syrup and water, and additive fluids, such as concentrates, sweeteners, and flavor syrups, are dispensed to form a mixed beverage. As multiple base fluids and multiple additive fluids are combined to form the mixed beverage, proper and adequate mixing of the fluids is necessary to ensure that the mixed beverages have consistent quality. There is therefore a need in the art for improved beverage dispensers that consistently mix base fluids and additive fluids that form various mixed beverages.

The following U.S. patents and U.S. patent application Publications are incorporated herein by reference in entirety.

U.S. Pat. No. 4,509,690 discloses a mixing nozzle for a post-mix beverage dispenser having a water supply chamber co-axially surrounding a syrup supply port, an elongate syrup diffuser having a spray head on its lower end, an upper water distribution disc on the diffuser having a plurality of apertures having a cumulative opening area for passage of water, a convex frusto-conical water spreader is directly below the upper disc, and a lower water distribution disc is spaced below the upper disc and the spreader.

U.S. Pat. No. 5,269,442 discloses a nozzle for a post-mix beverage dispensing valve for optimizing flow. The nozzle includes a first diffuser plate followed by a central flow piece having a frusto-conical outer water flow surface and an interior syrup flow channel Second and third diffuser plates follow the frusto-conical portion. The second and third diffuser plates have perimeter edges that contact the inner surface of a nozzle housing so that the carbonated water must flow through holes in the diffusers. In this manner the gradual reduction of pressure of the carbonated water to atmospheric can be controlled in part by increasing the surface area of the holes in each successive diffuser.

U.S. Pat. No. 7,665,632 discloses a flow splitter for use with a dispensing nozzle. The dispensing nozzle dispenses a first fluid and a second fluid. The flow splitter may include an inner chamber for collecting the first fluid and an outer chamber for collecting the second fluid. The inner chamber may include an internal vent so as to vent air into the inner chamber.

U.S. Pat. No. 7,866,509 discloses a dispensing nozzle assembly for dispensing a number of micro-ingredients into a fluid stream. The dispensing nozzle assembly may include a micro-ingredient mixing chamber, a number of micro-ingredient lines in communication with the micro-ingredient mixing chamber such that the micro-ingredients mix therein, and a mixed micro-ingredient exit such the mixed micro-ingredients are dispensed into the fluid stream.

U.S. Pat. No. 8,328,050 discloses dispensing nozzle assembly for dispensing a number of micro-ingredients into a fluid stream. The dispensing nozzle assembly may include a micro-ingredient mixing chamber, a number of micro-ingredient lines in communication with the micro-ingredient mixing chamber such that the micro-ingredients mix therein, and a mixed micro-ingredient exit such the mixed micro-ingredients are dispensed into the fluid stream.

U.S. Pat. No. 8,453,879 discloses a product dispenser that includes at least one macro-ingredient source, at least one micro-ingredient source positioned about the dispenser, a diluent source, a dispensing valve, a number of pumps or metering devices, and a user interface. The user interface receives a request for a product type and instructs the pumps or metering devices to dispense a predetermined type and ratio of macro-ingredients, micro-ingredients, and diluent to the dispensing valve for a predetermined flow rate.

U.S. Pat. No. 9,010,577 discloses a fountain beverage dispenser for constituting a beverage by mixture of a beverage syrup and a diluent for the syrup. The dispenser uses of a highly concentrated beverage syrup supply and at least one diluent and syrup blending station for diluting the highly concentrated syrup with diluent before the diluted syrup is mixed with diluent in the final mixture of syrup and diluent delivered to a dispensing nozzle.

U.S. Pat. No. 9,656,849 discloses a valve dispensing system that can be used in a beverage dispenser. The valve dispensing system has individual valve module components that control the flow of a beverage or beverage component, and a plurality of valve module components may be combined to form a system capable of dispensing a plurality of beverages and/or beverage components.

U.S. Patent Application Publication No. 2015/0315006 discloses a dispensing nozzle assembly with a core module with a diluent path and a sweetener path, an injector ring with a number of micro-ingredient paths and a number of macro-ingredient paths surrounding the core module, and a target assembly positioned about the core module.

U.S. Patent Application Publication No. 2018/0162710 discloses a dispensing nozzle assembly with a core module assembly and an injector ring assembly surrounding the removable core module assembly. The injector ring assembly may include a number of first paths surrounding the core module assembly and extending to a dispensing ring and a number of second paths surrounding the first paths and extending to the dispensing ring.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, an insert is for use with a beverage dispenser that has a base fluid module and an additive fluid manifold positioned around the base fluid module. The base fluid module has a chamber, a first conduit through which a first base fluid is conveyed into the chamber, and a second conduit through which a second base fluid is conveyed into the chamber. The additive fluid manifold has an inlet that receives an additive fluid and an outlet that dispenses the additive fluid. The insert includes a diffuser and a stem. The diffuser has a upstream end configured to be inserted into the chamber and to receive the first base fluid, a downstream end with an outlet configured to dispense the first base fluid, and a center bore extending between the upstream end and the downstream end along an axis. The stem is disposed in the center bore and has a first end configured to be coupled to the second conduit to thereby directly receive the second base fluid from the second conduit and an opposite second end with an outlet configured to dispense the second base fluid. The outlet of the diffuser is upstream from the outlet of the stem such that the first base fluid dispensed from the outlet of the diffuser mixes with the additive fluid before the second base fluid dispensed from the outlet of the stem mixes with the additive fluid.

In certain examples, a nozzle assembly is for use with a beverage dispenser that has a base fluid module and an additive fluid manifold positioned around the base fluid module. The base fluid module has a chamber, a first conduit through which a first base fluid is conveyed into the chamber, and a second conduit through which a second base fluid is conveyed into the chamber. The additive fluid manifold has an inlet that receives an additive fluid and an outlet that dispenses the additive fluid. The nozzle assembly has a nozzle and an insert with a diffuser and a stem. The nozzle has an upstream end, a downstream end, and a nozzle cavity that extends between the upstream end of the nozzle and the downstream end of the nozzle. The upstream end of the nozzle is configured to be coupled to the additive fluid manifold such that the nozzle is downstream from the base fluid module and the additive fluid manifold. The diffuser has a upstream end configured to be inserted into the chamber and to receive the first base fluid, a downstream end with an outlet configured to dispense the first base fluid into the nozzle cavity, and a center bore extending between the upstream end of the diffuser and the downstream end of the diffuser along an axis. The stem is disposed in the center bore and has first end configured to be coupled to the second conduit to thereby directly receive the second base fluid from the second conduit and an opposite second end with an outlet configured to dispense the second base fluid into the nozzle cavity. The second end of the stem is disposed in the nozzle cavity. The outlet of the diffuser is upstream from the outlet of the stem such that the first base fluid dispensed from the outlet of the diffuser mixes with the additive fluid before the second base fluid dispensed from the outlet of the stem mixes with the additive fluid. The additive fluid and the first base fluid are conveyed together toward the downstream end of the nozzle and the second base fluid mixes with the additive fluid and the first base fluid downstream of the outlet of the stem to thereby form a mixed beverage that is dispensed from the downstream end of the nozzle.

Various other features, objects, and advantages will be made apparent from the following description taken together with the drawings.

BRIEF DESCRIPTION OF THE DRAWINGS

The present disclosure includes reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed. The different apparatuses, systems, and methods described herein may be used alone or in combination with other apparatuses, systems, and methods. Various equivalents, alternatives, and modifications are possible within the scope of the appended claims.

Figure 1:
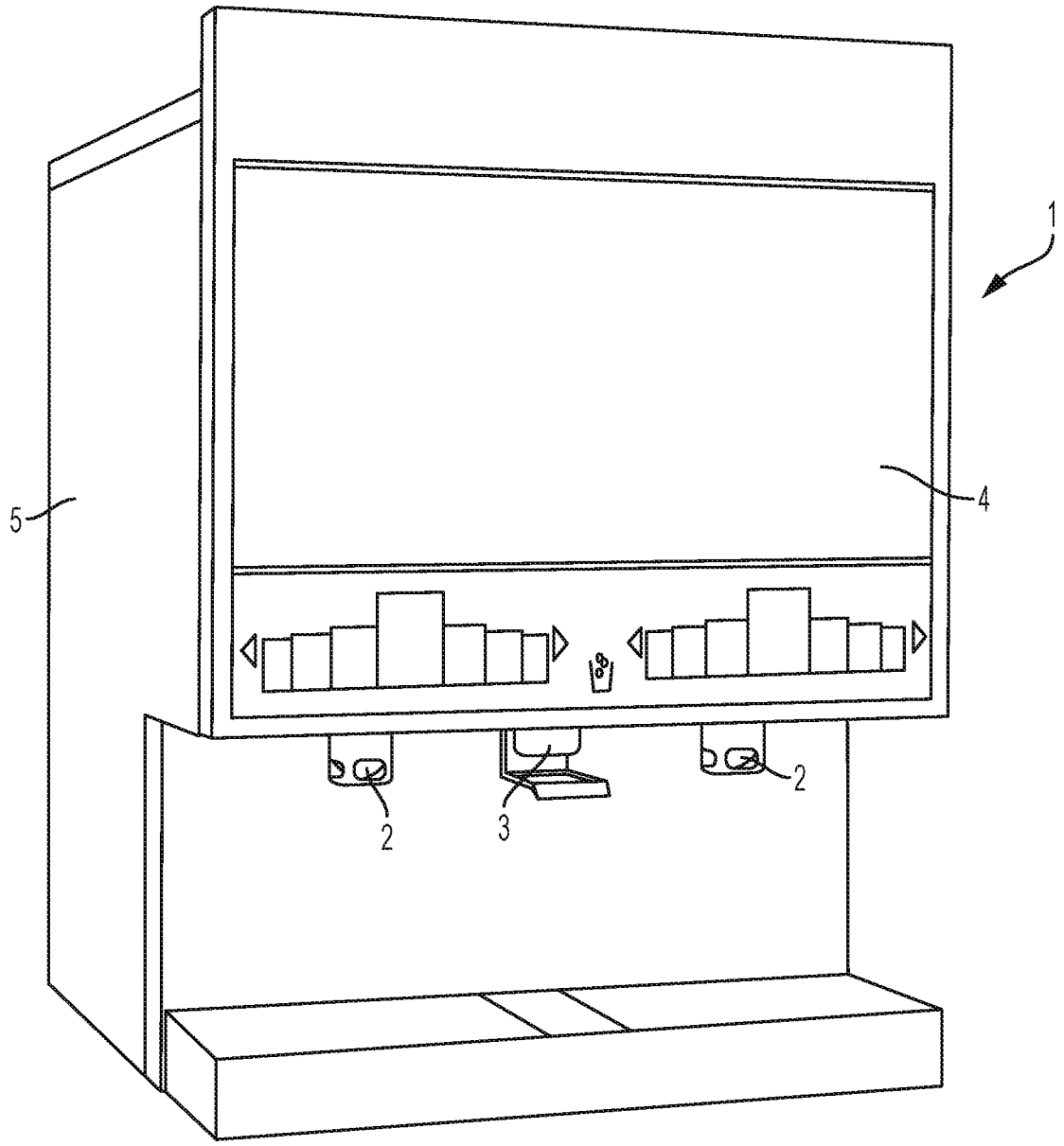
FIG. 1 is a perspective view of an example beverage dispenser.
Figure 2:
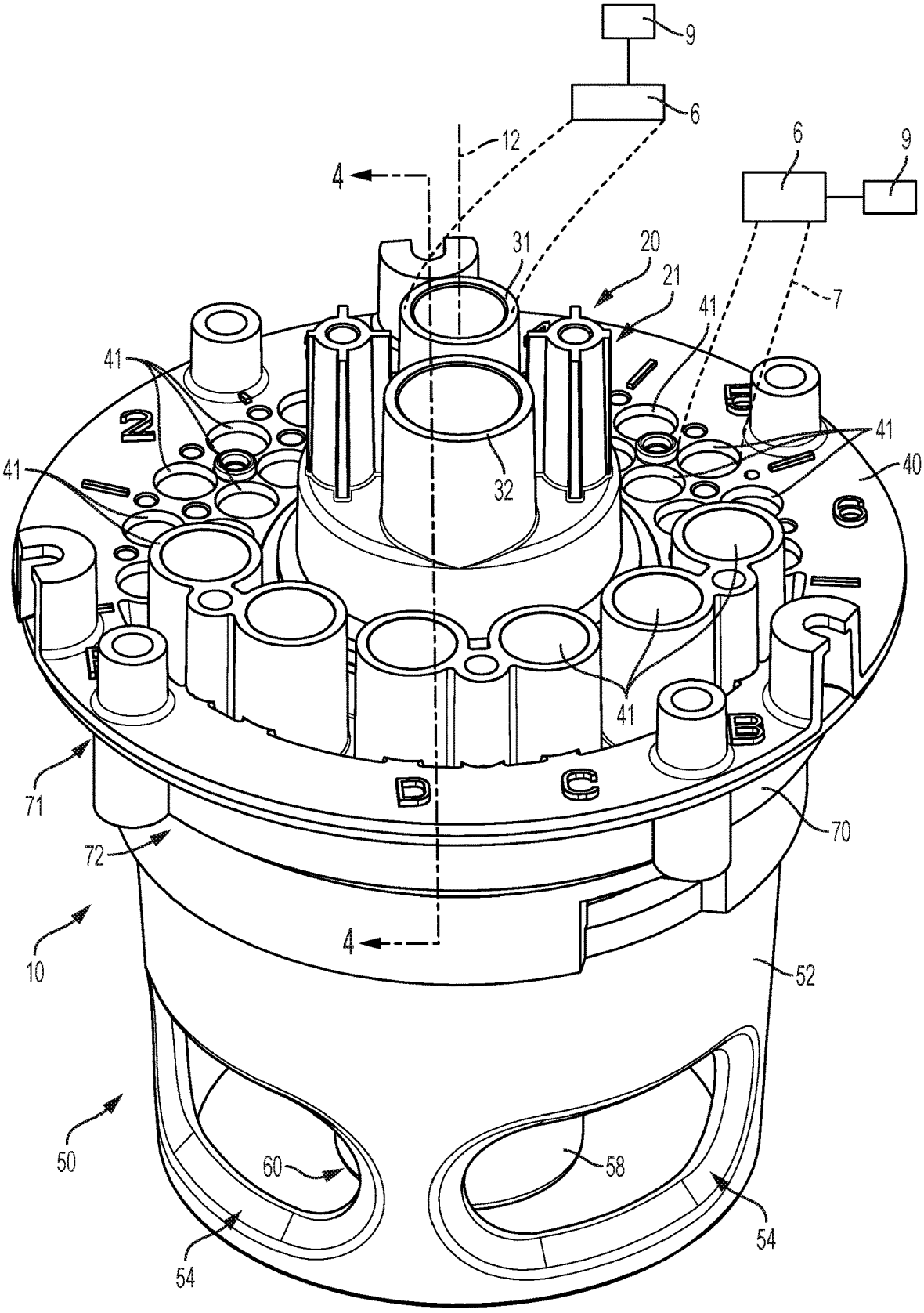
FIG. 2 is a perspective view of an example beverage dispensing assembly according to the present disclosure.

FIG. 1 is an example beverage dispenser 1 that dispenses a mixed beverage, such as a post-mixed beverage, to the operator of the beverage dispenser 1. The beverage dispenser 1 includes a nozzle 2 from which the mixed beverage is dispensed, an ice chute 3 from which ice is dispensed, a user input device 4 (e.g. touch screen) that receives user inputs from the operator, and a housing 5 which encloses various components of the beverage dispenser 1, such as valves, manifolds, fluid lines, and the like. Reference is made to the above-incorporated U.S. patents for examples of conventional beverage dispensers and components thereof.

FIGS. 2-5 depict an example beverage dispensing assembly 10 of the present disclosure that is included in the beverage dispenser 1 (FIG. 1) and is configured to dispense a custom, mixed beverage to the operator. The beverage dispensing assembly 10 can be configured to form the desired or selected mixed beverage from different types of fluids including base fluids (e.g. diluents, water, high fructose corn syrup "HFCS", carbonated water) and additive fluids (e.g. syrup solutions, concentrated fluids, highly concentrated fluids, brand beverage flavoring, additive flavoring, nutrients, caffeine, vitamins) The base fluids and the additives fluids are supplied to the beverage dispensing assembly 10 via fluid supply lines 7 from fluid sources 9, such as a carbonated water tank and bag-in-box fluid storage unit (note only two fluid supply lines 7 and two fluid sources 9 are shown on FIG. 2 for clarity). The flow of the fluids through the fluid supply lines 7 and dispensed from the beverage dispensing assembly 10 is regulated and controlled by upstream valves 6 which are opened and closed by a controller (not shown) based on the user inputs received, such as user inputs received into the user input device 4. The amount and number of base fluids and/or additive fluids dispensed and mixed by the beverage dispensing assembly 10 to form the desired mixed beverage can vary.

Figure 3:
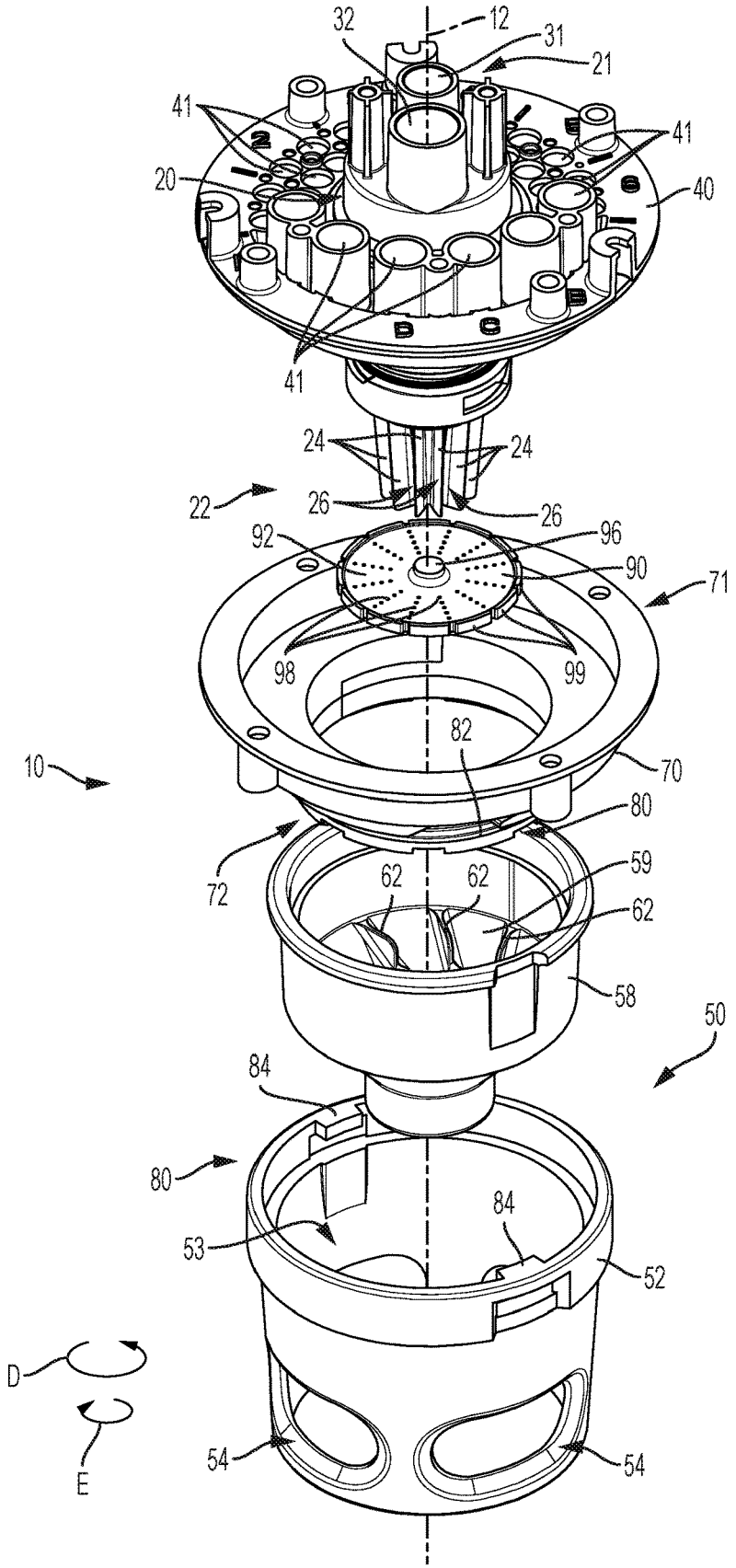
FIG. 3 is an exploded view of the beverage dispensing assembly of FIG. 2.
Figure 4:
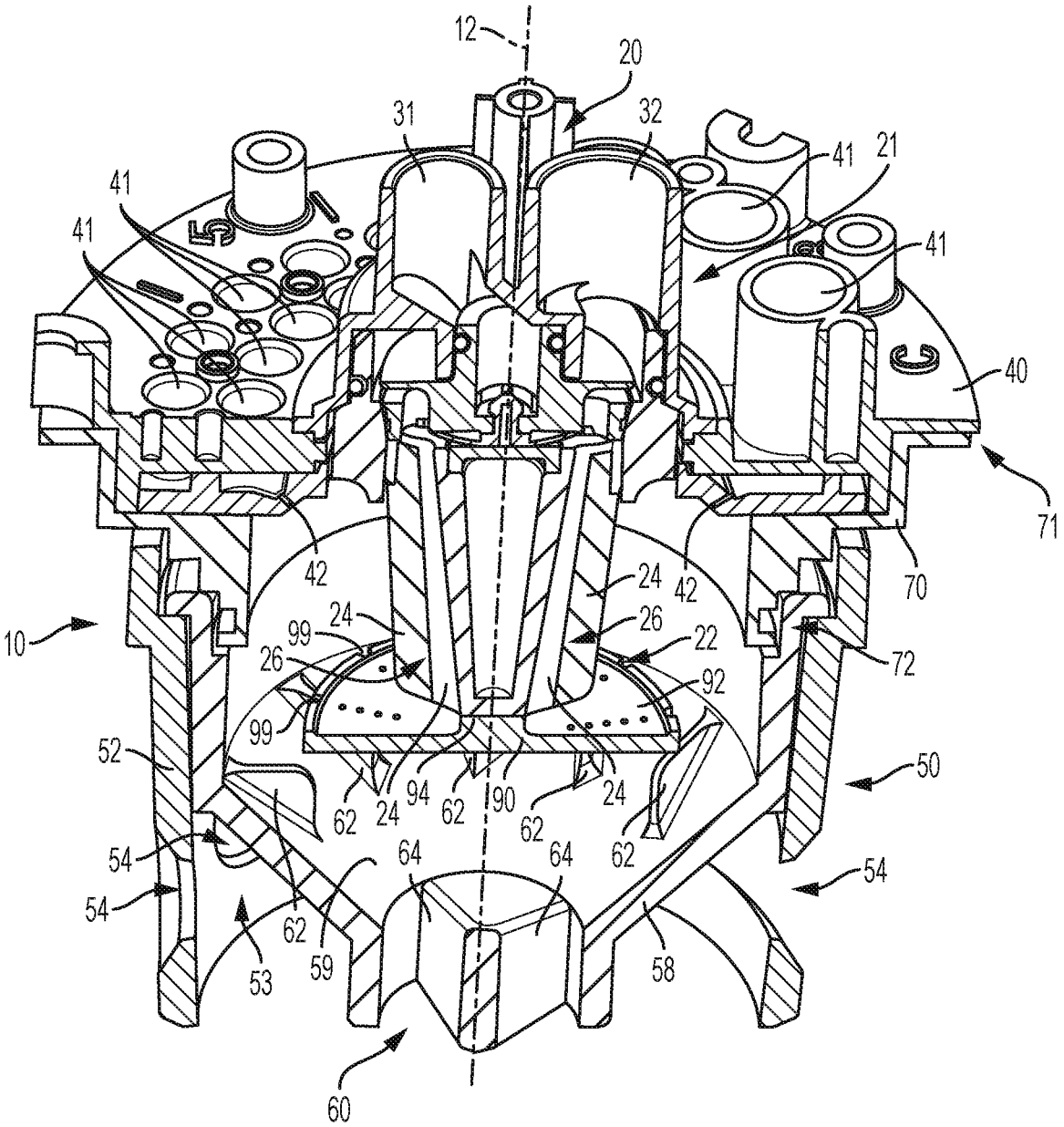
FIG. 4 is a cross sectional view of the beverage dispensing assembly of FIG. 2 along line 4-4 on FIG. 2.
Figure 5:
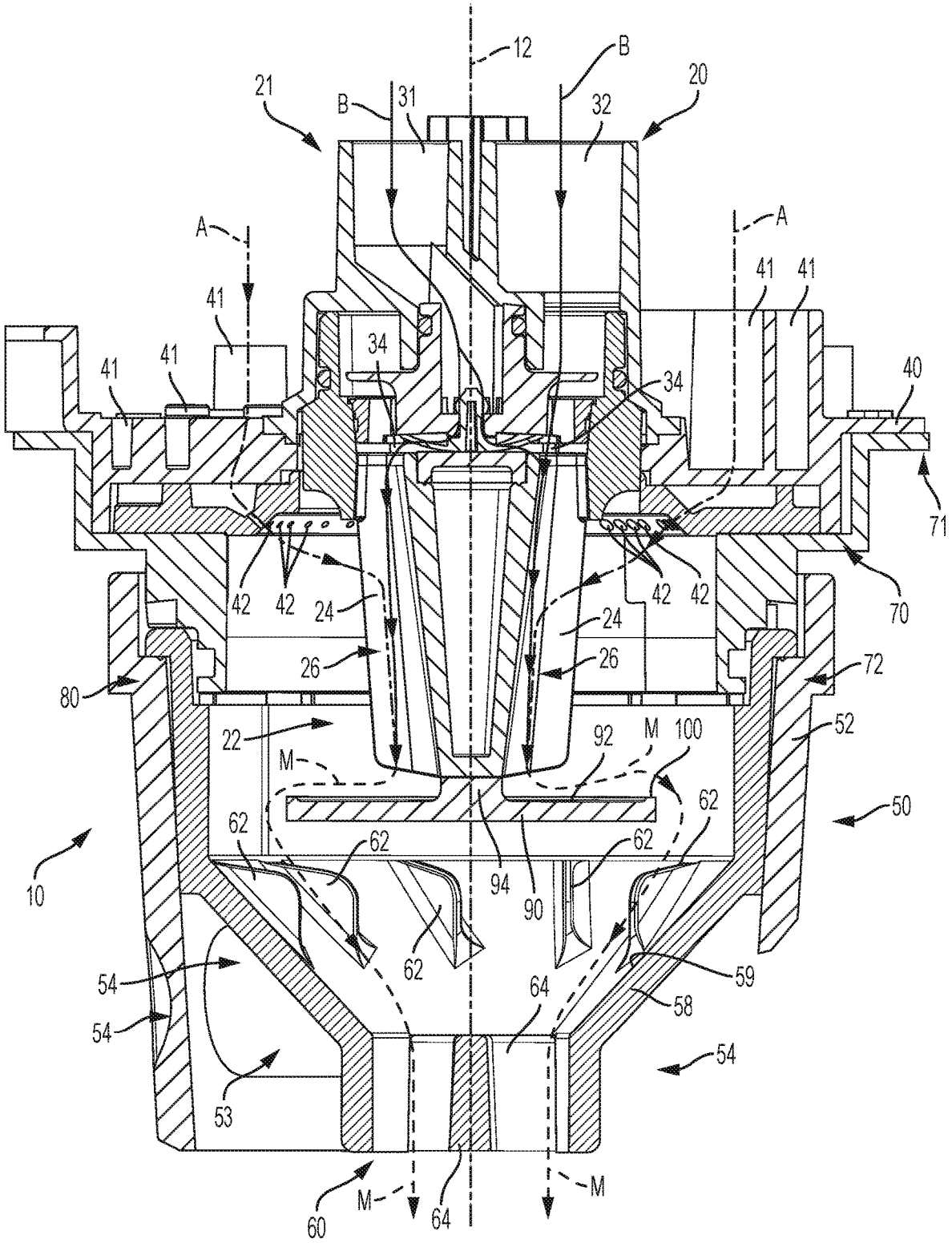
FIG. 5 is a cross sectional view like FIG. 4.

As is best seen in FIGS. 3-5, the beverage dispensing assembly 10 includes a base fluid module 20 configured to receive and dispense base fluids B (see solid lines B in FIG. 5). The base fluid module 20 includes an upstream end 21 and a downstream end 22. The upstream end 21 has a plurality of inlets or ports that are configured to receive base fluids. In the example depicted, a first base fluid inlet 31 is configured to receive a first base fluid and a second base fluid inlet 32 is configured to receive a second base fluid. The downstream end 22 has a plurality of outlets 34 (FIG. 5) concentrically spaced at the downstream end 22. The outlets 34 dispense the first base fluid, the second base fluid, or a mixed base fluid which includes prescribed amounts of the first base fluid and the second base fluid.

The base fluid module 20 is centered about a center axis 12 of the beverage dispensing assembly 10, and the base fluid module 20 has a plurality of fins 24 that axially extend from the downstream end 22. One of the fins 24 is positioned between each of the downstream outlets 34 so as to define a plurality of channels 26 through which the base fluid(s) dispense. That is, the base fluid(s) that are dispensed from the outlets 34 flow downstream through the channels 26 defined by the fins 24. The number of fins 24 can vary, and in one example, the number of fins 24 is greater than the number of outlets 34. Furthermore, the base fluid module 20 can include stubs, ports, chambers, cavities, passageways, and/or apertures of any shape, size, and/or number that are configured to receive, direct, and/or dispense the base fluids in the base fluid module 10 as the base fluids flow from upstream to downstream there through. A person having ordinary skill in the art will recognize that the number and type of base fluids received and dispensed from the base fluid module 20 can vary.

The beverage dispensing assembly 10 includes an additive fluid manifold 40 positioned or centered about the center axis 12 and configured to receive and dispense additive fluids A (see dash-dot-dash lines A in FIG. 5). The shape and/or the positioning of the additive fluid manifold 40 can vary, and in the example depicted, the additive fluid manifold 40 is annular and encircles the base fluid module 20. The additive fluid manifold 40 includes any number of additive inlets 41 that receive additive fluids. In the example depicted, thirty additive inlets 41 receive up to thirty additives from additive fluid source(s) 9 (e.g. bag-in-box additive fluid source) via additive supply line(s) 7 (see FIG. 2). The additive fluid manifold 40 also includes a plurality of additive outlets 42 that are configured to radially inwardly spray the additive fluids toward and into the base fluid(s) as the base fluid(s) is dispensed through the channels 26 to thereby form a mixed beverage (see dashed lines M in FIG. 5). The number of additive outlets 42 can correspond to the number of additive inlets 41, and the size and/or shape of the additive inlets 41 and the additive outlets 42 can vary based on the type of additive fluid. For example, high viscosity and low ratio additive fluids (e.g. five parts base fluid and one part additive fluid; 5:1) may be conveyed through larger additive inlets 41 and/or additive outlets 42 than low viscosity and high ratio additive fluids (e.g. two hundred parts base fluid and one part additive fluid; 200:1) with are conveyed through smaller additive inlets 41 and/or additive outlets 42. The additive outlets 42 are concentrically spaced around the base fluid module 20. A person having ordinary skill in the art will recognize that the number and type of additive fluids received and dispensed from the additive fluid manifold 40 can vary. Furthermore, the additive fluid manifold 40 can include stubs, ports, chambers, cavities, passageways, and/or apertures of any shape, size, and/or number that are configured to receive, direct, spray, and/or dispense the additive fluids towards and into the base fluid.

The beverage dispensing assembly 10 includes a nozzle 50 centered about the center axis 12 and positioned downstream of the base fluid module 20 and the additive fluid manifold 40. The nozzle 50 has an outer shell 52 that defines a bore 53 and a funnel 58 that nests in the bore 53. The funnel 58 has an inner surface 59 that directs the mixed beverage radially inwardly toward the center axis 12 and a downstream funnel outlet 60. Projections 64 (FIG. 4) are positioned near the funnel outlet 60 to direct the mixed beverage as it is dispensed. The inner surface 59 forms a truncated cone. The funnel 58 can include nozzle fins 62 that transversely extend from the inner surface 59 and are configured to redirect the mixed beverage and thereby further mix the mixed beverage. The outer shell 52 is configured to protect the funnel 58 and may include any number of material cutouts 54.

An adapter 70 is used to removably fasten or couple the nozzle 50 to the additive fluid manifold 40. The adapter 70 has an upper end 71 that is coupled to the additive fluid manifold 40 and an opposite, lower end 72 that receives or couples to the nozzle 50. The adapter 70 can be fixedly or removably coupled to the additive fluid manifold 40 and the nozzle 50 by any suitable fasteners, such as screws and adhesives. For example, the adapter 70 is fixedly coupled to the additive fluid manifold 40 by screws and nozzle 50 is removably coupled to the nozzle 50 by a quick-connect fittings 80 (see FIG. 3).

As is best seen in FIG. 3, each quick-connect fitting 80 comprises a slot 82 on one of the lower end 72 of the adapter 70 and the nozzle 50 and a tab 84 on the other of the lower end 72 of the adapter 70 and the nozzle 50. The slot 82 and the tab 84 are located relative to each other such that twisting of the nozzle 50 cams the nozzle 50 into the locked position (see arrow D on FIG. 3 which illustrates a twisting force in a first direction) with respect to the lower end 72 of the adapter 70 and such that opposite twisting of the nozzle 50 cams the nozzle 50 into the unlocked position (see arrow E on FIG. 3 which illustrates an opposite twisting force in a second direction which is opposite the first direction as illustrated by arrow D) with respect to the lower end 72 of the adapter 70.

Figure 9:
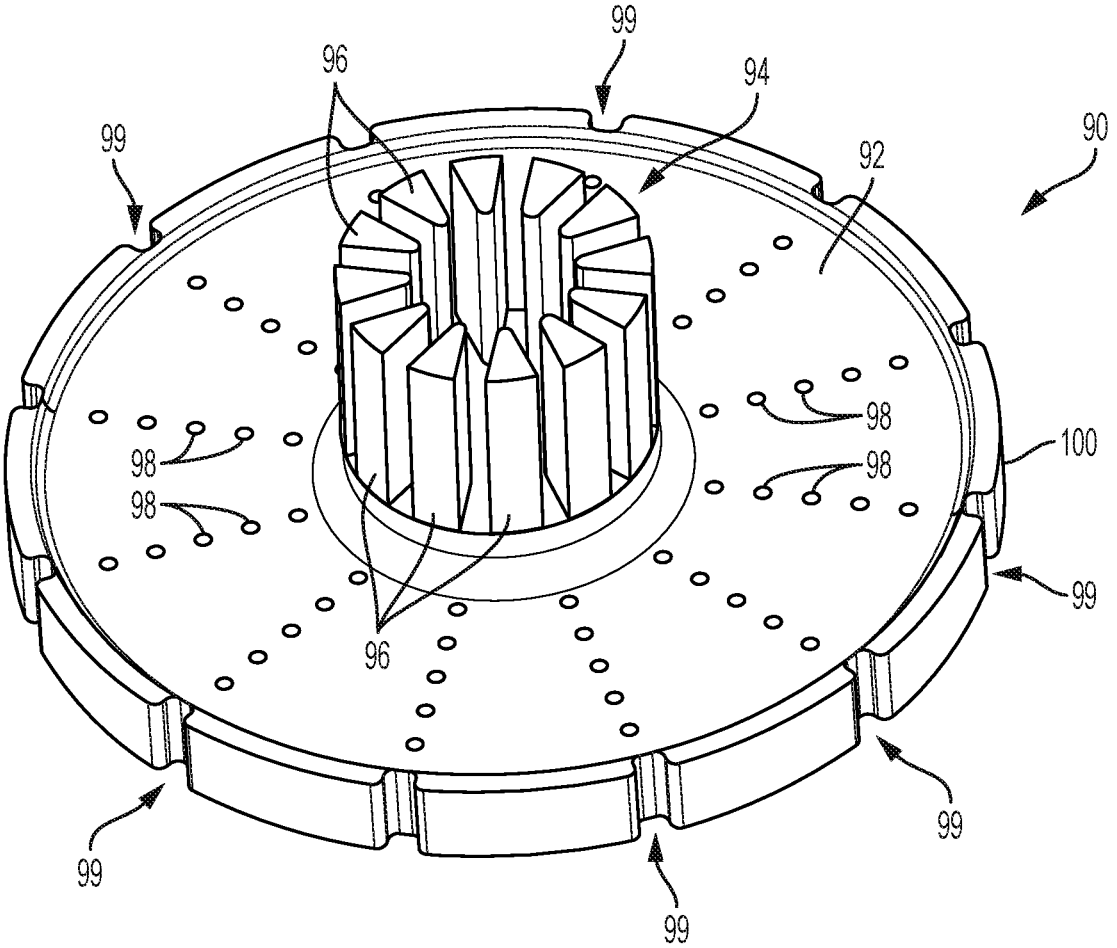
FIG. 9 is a perspective view of another example diverter.

Returning to FIGS. 4-5, a diverter 90 is positioned in the bore 53 and is configured to redirect the mixed beverage and thereby further mix the mixed beverage. The diverter 90 is centered about the center axis 12 such that the mixed beverage is directed radially outwardly toward the inner surface 59 of the funnel 58. The diverter 90 has a diverter surface 92 and a boss 94 that is coupled to the base fluid module 20. The boss 94 is coupled to the base fluid module 20 by any suitable fastener or coupler, such as a screws and adhesives. In certain examples, the diverter 90 is integrally formed with the base fluid module 20 or the additive fluid manifold 40. In another example, the boss 94 includes a plurality of axially extending ribs 96 (see FIG. 9) configured to cooperate with the fins 24 to thereby couple the diverter 90 to the base fluid module 20 such that the diverter 90 is spaced apart from the funnel 58 (e.g. the ribs 96 permit the diverter 90 to be suspended in bore 53 relative to the inner surface 59 of the funnel 58). In other examples, the diverter 90 is coupled to and/or integrally formed with the funnel 58 and/or the nozzle 50.

Figure 6:
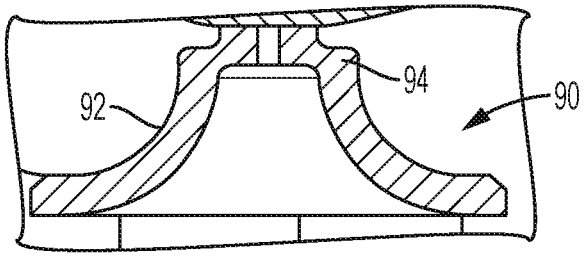
FIG. 6 is a cross sectional view of an example diverter.
Figure 7:
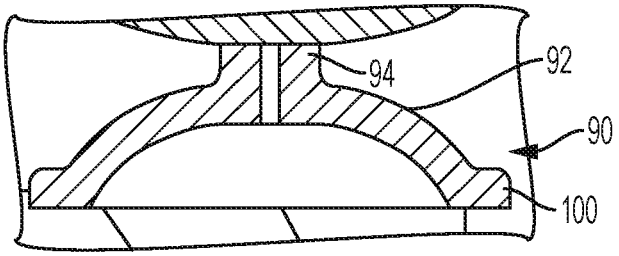
FIG. 7 is a cross sectional view of another example diverter.
Figure 8:
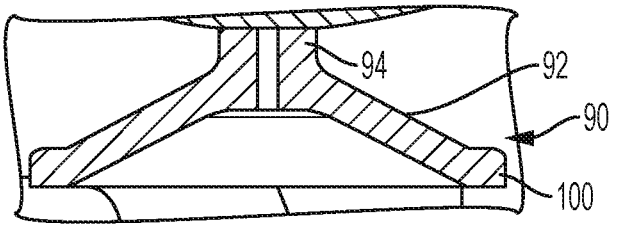
FIG. 8 is a cross sectional view of another example diverter.

The size and the shape of the diverter 90 can vary. For example, the diverter 90 can include a planar diverter surface 92 (FIGS. 4-5), a concave diverter surface 92 (FIG. 6), a convex diverter surface 92 (FIG. 7), or a radially outwardly sloped diverter surface 92 (FIG. 8). The diverter 90 can include drain holes 98 (FIG. 9) to allow for residual mixed beverage to drain through the diverter 90. The diverter 90 can include notches 99 (FIG. 9) along a perimetral edge 100 that are configured to further mix the mixed beverage. In certain examples, the perimetral edge 100 is an upturned edge (as been seen on FIG. 4).

Figure 10:
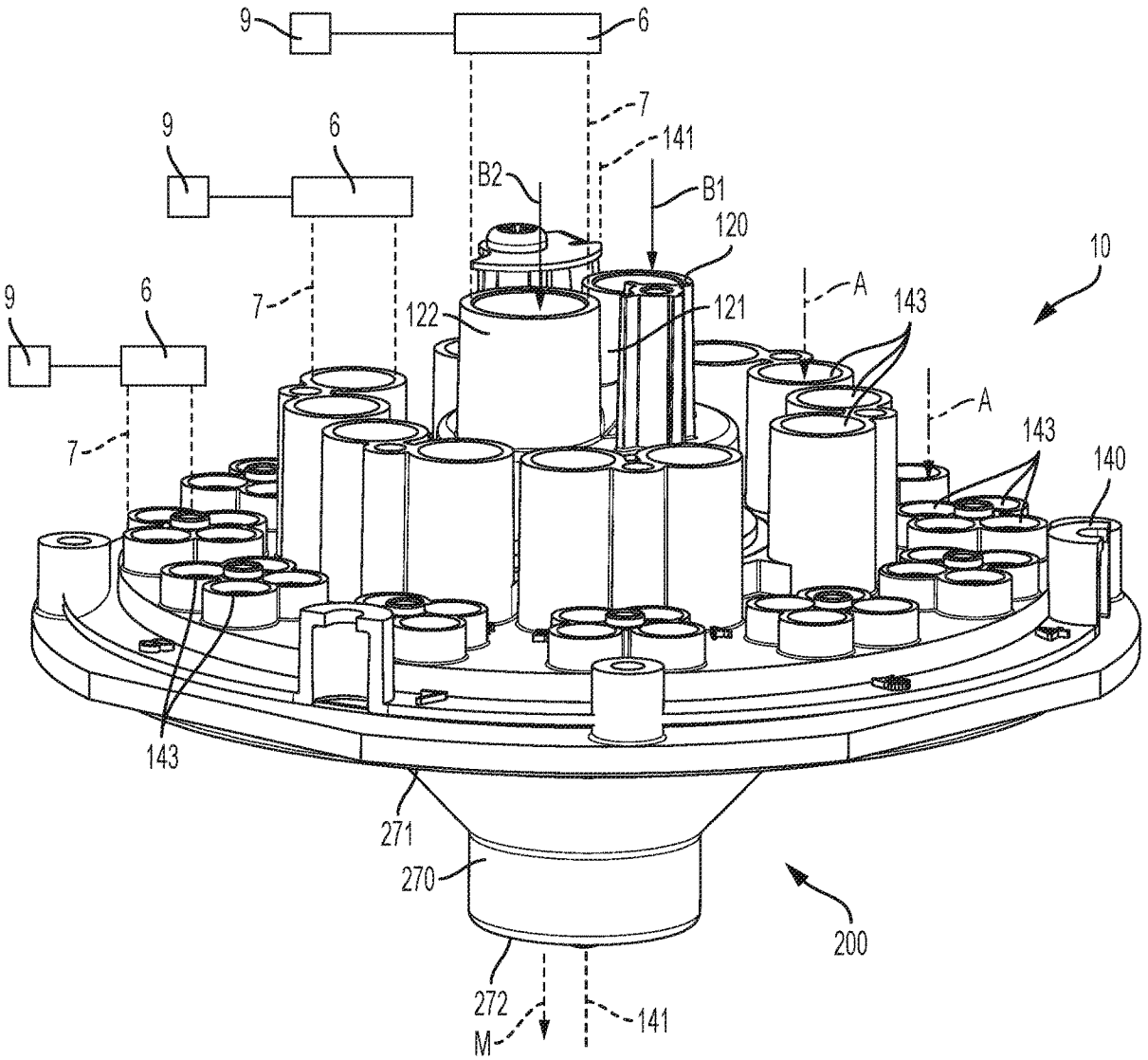
FIG. 10 is a perspective view of another beverage dispensing assembly of the present disclosure.

FIGS. 10-23 depict another example beverage dispensing assembly 10 of the present disclosure. FIG. 10 is a perspective view of the beverage dispensing assembly 10. The base fluids and the additives fluids are supplied to the beverage dispensing assembly 10 via fluid supply lines 7 from fluid sources 9, and the flow of the base fluids and the additive fluids through the fluid supply lines 7 and dispensed from the beverage dispensing assembly 10 are regulated and controlled by upstream valves 6 which are opened and closed by a controller (not shown) (note only three fluid supply lines 7, three fluid sources 9, and three valves 6 are shown on FIG. 10 for clarity).

The fluid characteristics, such as viscosity, of the base fluids and the additive fluids used to form the mixed beverage can vary. In addition, the base fluids and the additive fluids may be changed by the owner of the beverage dispenser to match the mixed beverages demanded by the consumers. As the base fluids and additive fluids are changed, the manner in which the fluids are mixed in the beverage dispenser may also need to be changed in order to maintain consistency of the mixed beverages dispensed. Accordingly, the present inventors have developed the nozzle assembly of the present disclosure that can be attached to and detached from the beverage dispensing assembly as the base fluids and the additive fluids are changed to form different mixed beverages.

Figure 11:
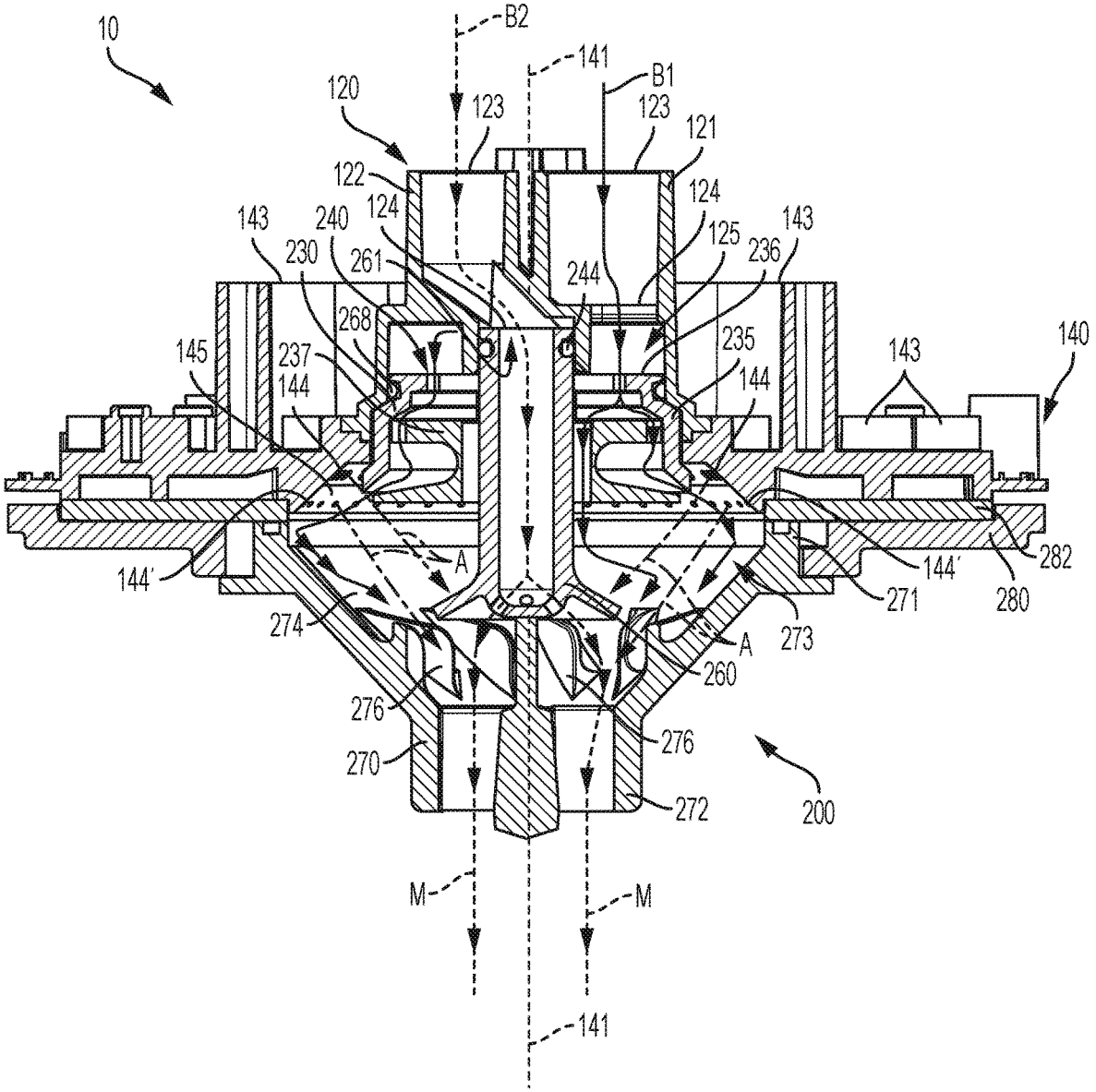
FIG. 11 is a cross sectional view of the beverage dispensing assembly shown in FIG. 10.
Figure 12:
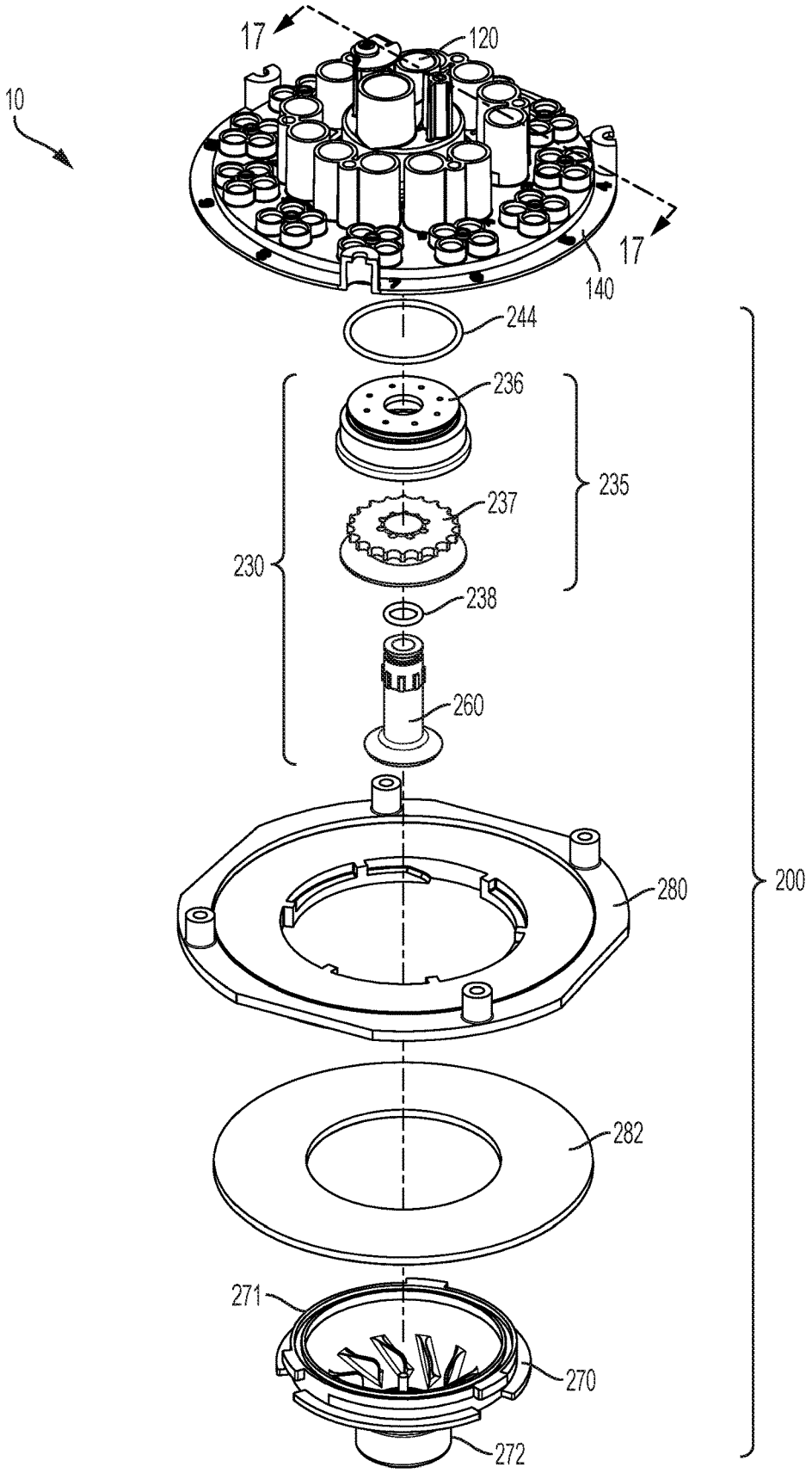
FIG. 12 is an exploded view of the beverage dispensing assembly of FIG. 10.

As is best seen on FIGS. 11-12, the beverage dispensing assembly 10 includes a base fluid module 120 (which is similar to the base fluid module 20 described above with reference to FIGS. 2-5), an additive fluid manifold 140 (which is similar to the additive fluid manifold 40 described above with reference to FIGS. 2-5), and a nozzle assembly 200 that is removably coupled to the base fluid module 120 and/or the additive fluid manifold 140. As will be described further herein, a first base fluid (shown as solid lines B1 on FIG. 11), a second base fluid (shown as dashed lines B2 on FIG. 11), and a plurality of additive fluids (shown as dash-dot-dash lines A on FIG. 11) are conveyed through the beverage dispensing assembly 10 to form the mixed beverage (shown as dashed lines M on FIG. 11). The components and features of the base fluid module 120, the additive fluid manifold 140, and the nozzle assembly 200 are described herein below.

Figure 13:
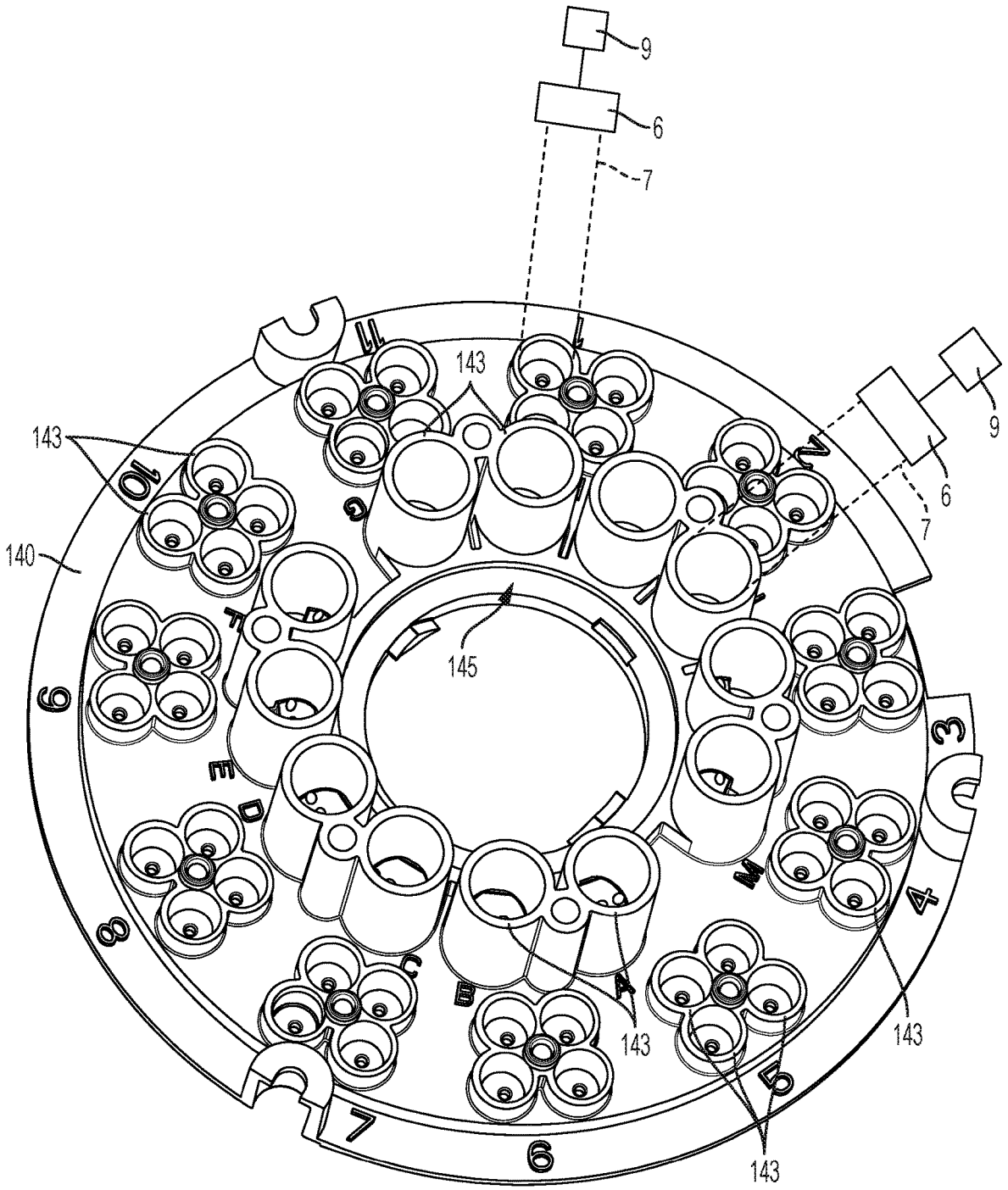
FIG. 13 is a top perspective view of an example additive fluid manifold shown in FIG. 12.
Figure 14:
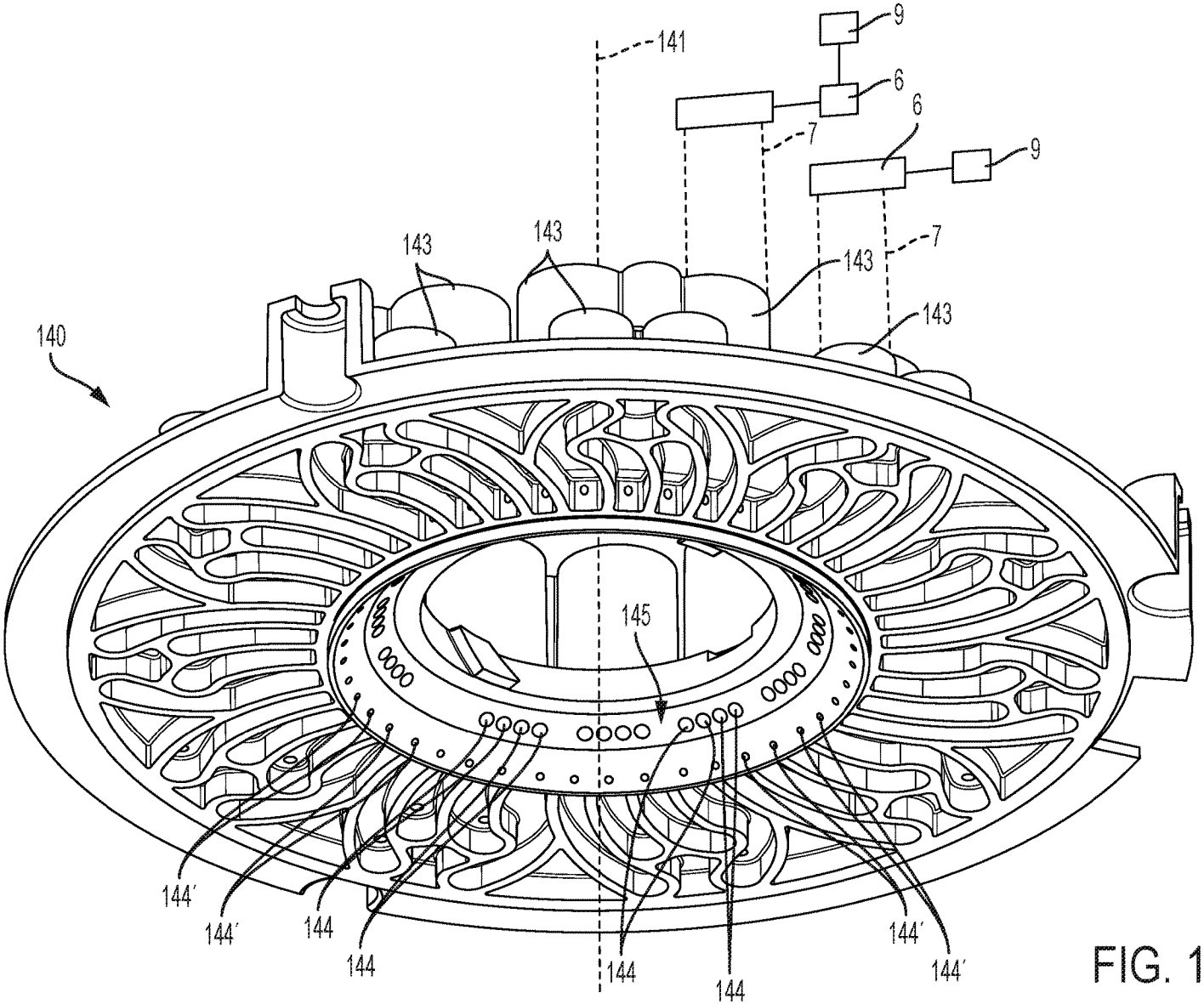
FIG. 14 is a bottom perspective view of the additive fluid manifold shown in FIG. 13.

Referring now to FIGS. 13-14 an example additive fluid manifold 140 is depicted. The additive fluid manifold 140 is positioned around the base fluid module 120 (see FIG. 11) and has a center axis 141 (FIG. 14). The additive fluid manifold 140 receives a plurality of additive fluids from fluid supply lines 7 that are connected to valves 6 and fluid sources 9 (note that only two fluid supply lines 7, two fluid sources 9, and two valves 6 are shown in FIGS. 13-14 for clarity). The additive fluid manifold 140 includes a plurality of inlets 143 that receive the additive fluids from the fluid supply lines 7 and at least one outlet 144, 144' that dispense and spray the additive fluids toward the center axis 141. The outlets 144, 144' are concentrically spaced along a radially inner perimeter 145 of the additive fluid manifold 140. In certain examples, low ratio (5:1) additive fluids are dispensed from upstream outlets 144 and high ratio (200:1) additive fluids are dispensed from downstream outlets 144'.

Figure 15:
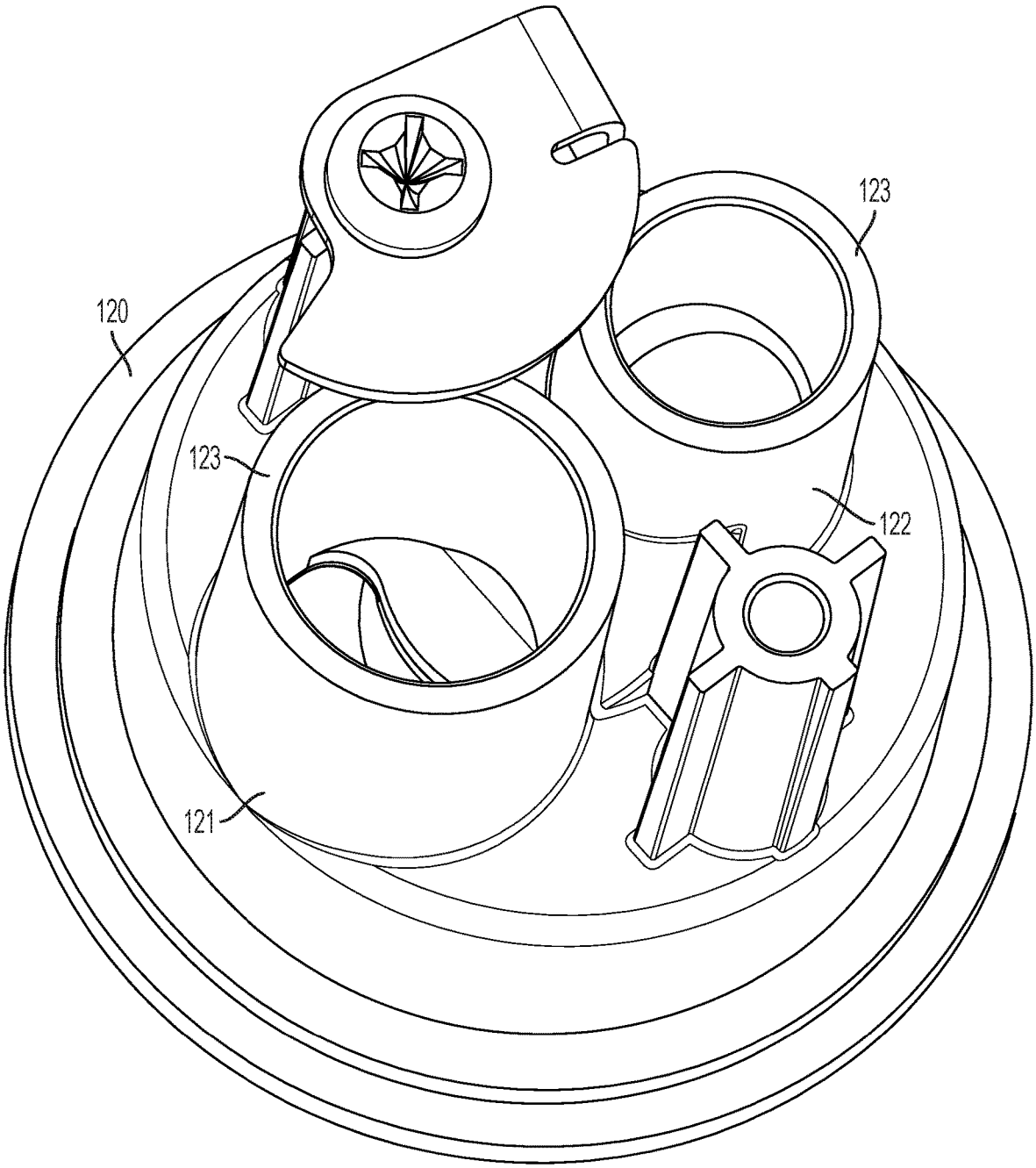
FIG. 15 is a top perspective view of an example base fluid module shown in FIG. 12.
Figure 16:
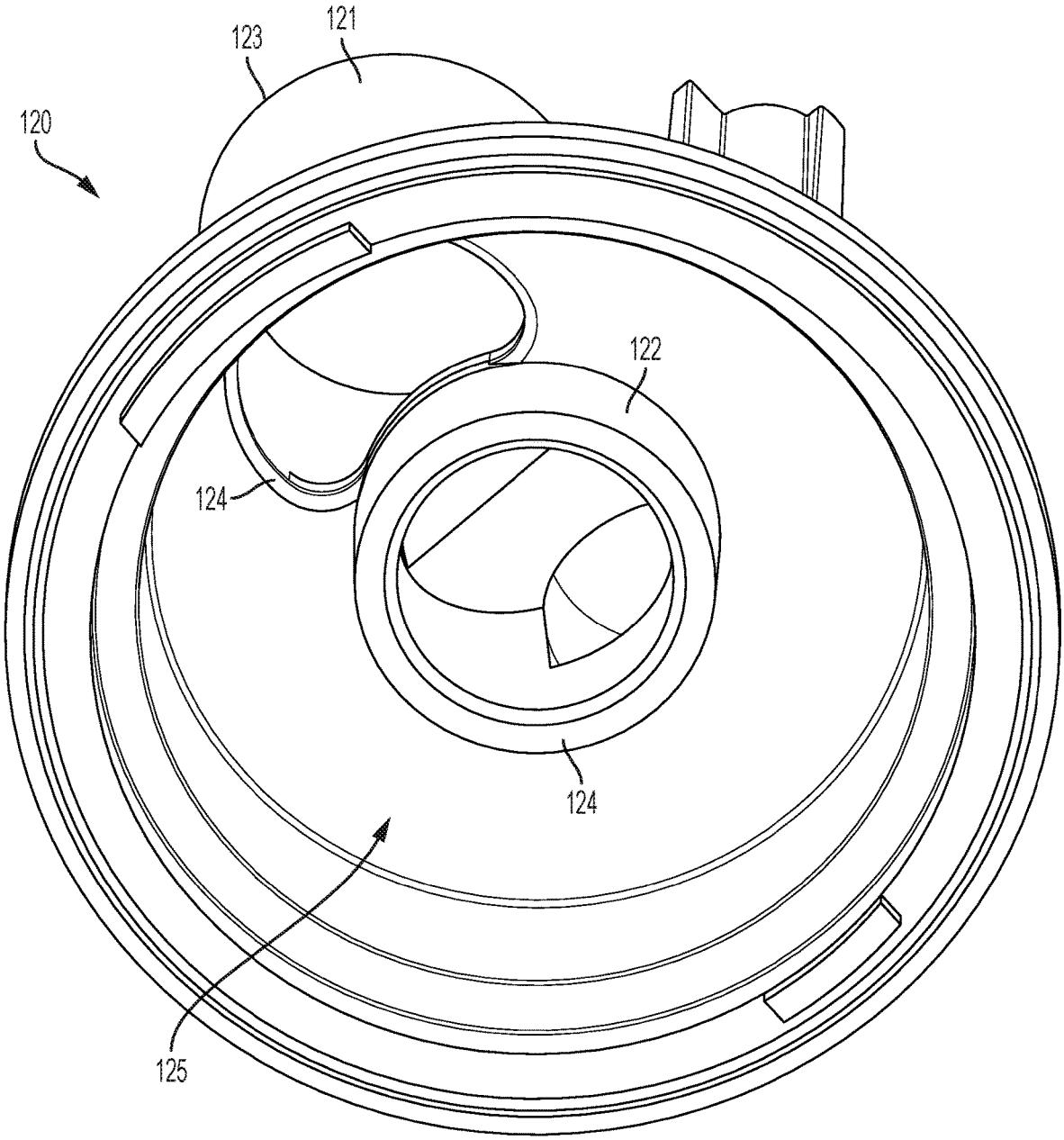
FIG. 16 is a bottom perspective view of the base fluid module shown in FIG. 15.
Figure 17:
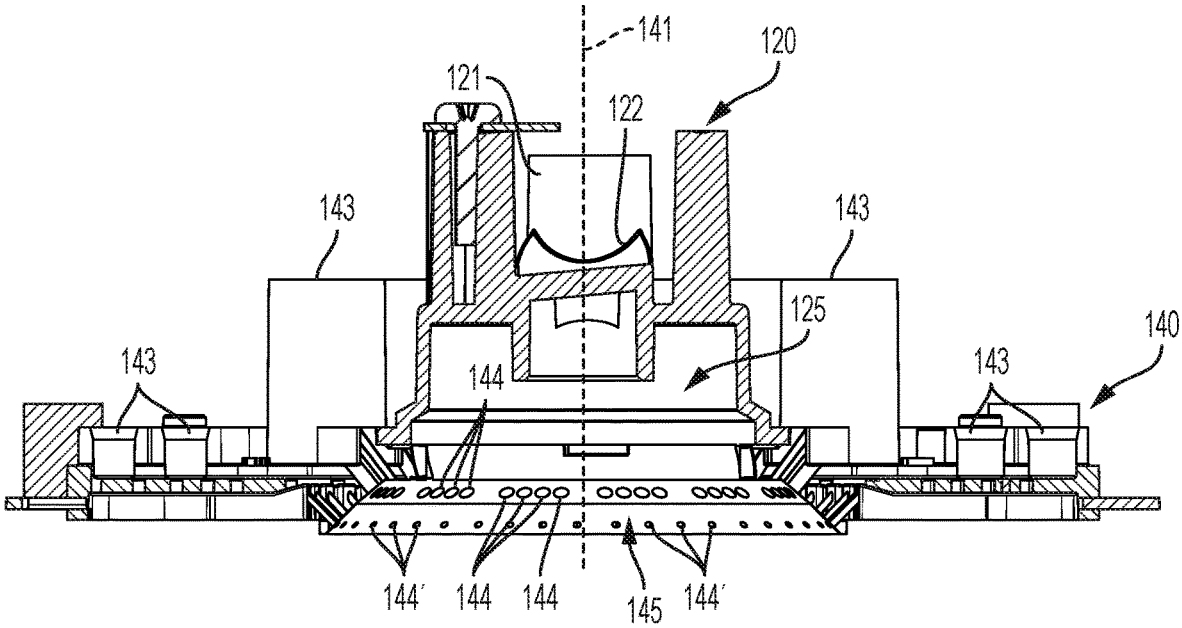
FIG. 17 is a cross sectional view of the additive fluid manifold and the base fluid module along line 17-17 on FIG. 12.

FIGS. 15-16 depict an example base fluid module 120. The base fluid module 120 has a chamber 125 (FIG. 16), a first conduit 121 through which a first base fluid is conveyed into the chamber 125, and a second conduit 122 through which a second base fluid is conveyed into the chamber 125. Each conduit 121, 122 has an inlet 123 that receives the base fluid from fluid supply lines 7 (FIG. 10) and an outlet 124 (FIG. 16) through which the first and second base fluids are dispensed into the chamber 125. FIG. 17 depicts the additive fluid manifold 140 positioned around the base fluid module 120. Examples of other conventional additive fluid manifolds and base fluid modules are disclosed in the above-incorporated U.S. patents and U.S. patent application Publications.

Referring back to FIG. 12, the nozzle assembly 200 is removably couplable to the base fluid module 120 and/or the additive fluid manifold 140. The nozzle assembly 200 includes an insert 230 and a nozzle 270 from which the mixed beverage is dispensed. FIGS. 18-22 depict the nozzle 270 and the insert 230 of the nozzle assembly 200 in greater detail.

The insert 230 is received into the chamber 125 of the base fluid module 120, as shown in FIG. 11, and the nozzle 270 (which is similar to the nozzle 50 described above with reference to FIGS. 2-5) is configured to be coupled to the additive fluid manifold 140 at an upstream end 271 such that the nozzle 270 is downstream from the base fluid module 120 and the additive fluid manifold 140 (see FIG. 11). Optionally, an adapter plate 280 and a retaining ring 282 (FIG. 12) can be coupled to the additive fluid manifold 140 and the nozzle 270 is then coupled to the adapter plate 280 and/or the retaining ring 282. That is, the adapter plate 280 and/or the retaining ring 282 provide surfaces on which the nozzle 270 can be indirectly coupled to the additive fluid manifold 140.

Figure 18:
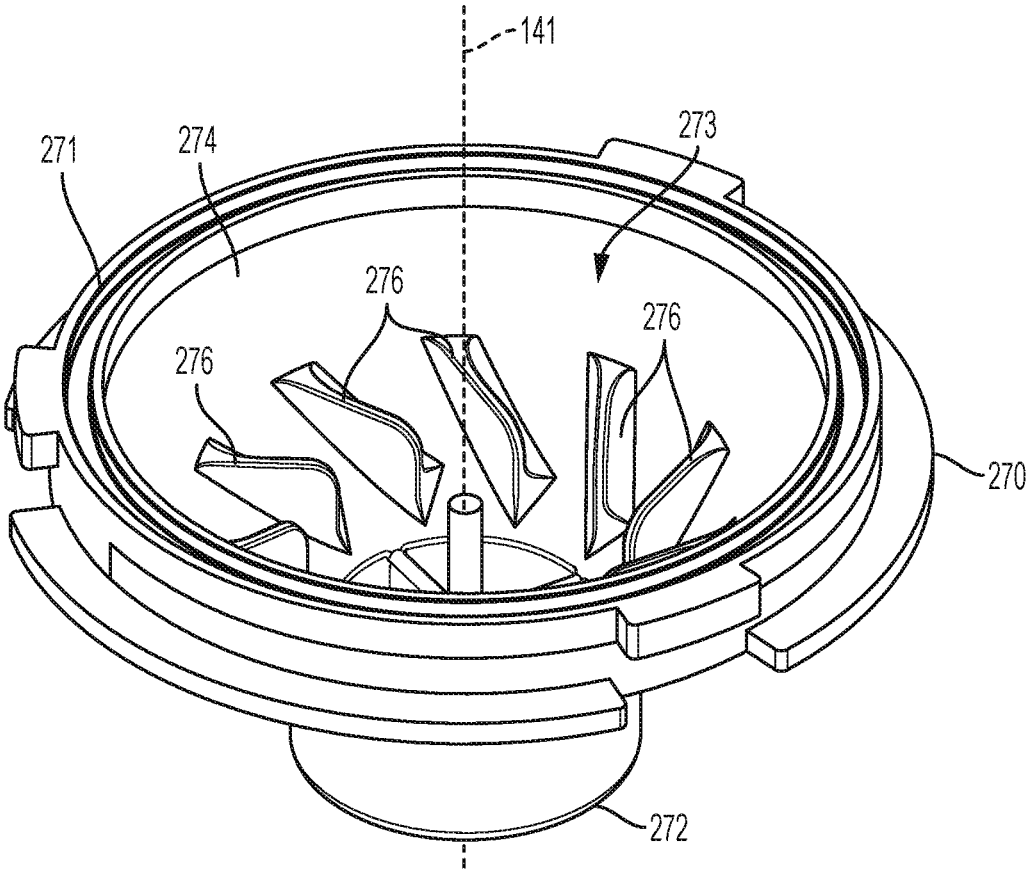
FIG. 18 is a perspective view of a nozzle shown in FIG. 12.

Referring to FIG. 18, the nozzle 270 has a nozzle cavity 273 that extends between the upstream end 271 and a downstream end 272. The upstream end 271 is radially enlarged compared to the downstream end 272 and may extend radial to and surround a portion of the insert 230 (see FIG. 11). The nozzle 270 has an interior surface 274 that slopes radially inwardly toward the center axis 141 of the additive fluid manifold 140 on which the nozzle 270 is centered. The base fluids and the additive fluids are received into the upstream end 271 and the mixed beverage formed from the base fluids and the additive fluids is dispensed from the downstream end 272. Nozzle fins 276 transversely extend from the interior surface 274 and are configured to redirect the mixed beverage and thereby mix the first base fluid, the second base fluid, and the additive fluid(s) as the fluids are conveyed along the interior surface 274 of the nozzle 270.

Figure 19:
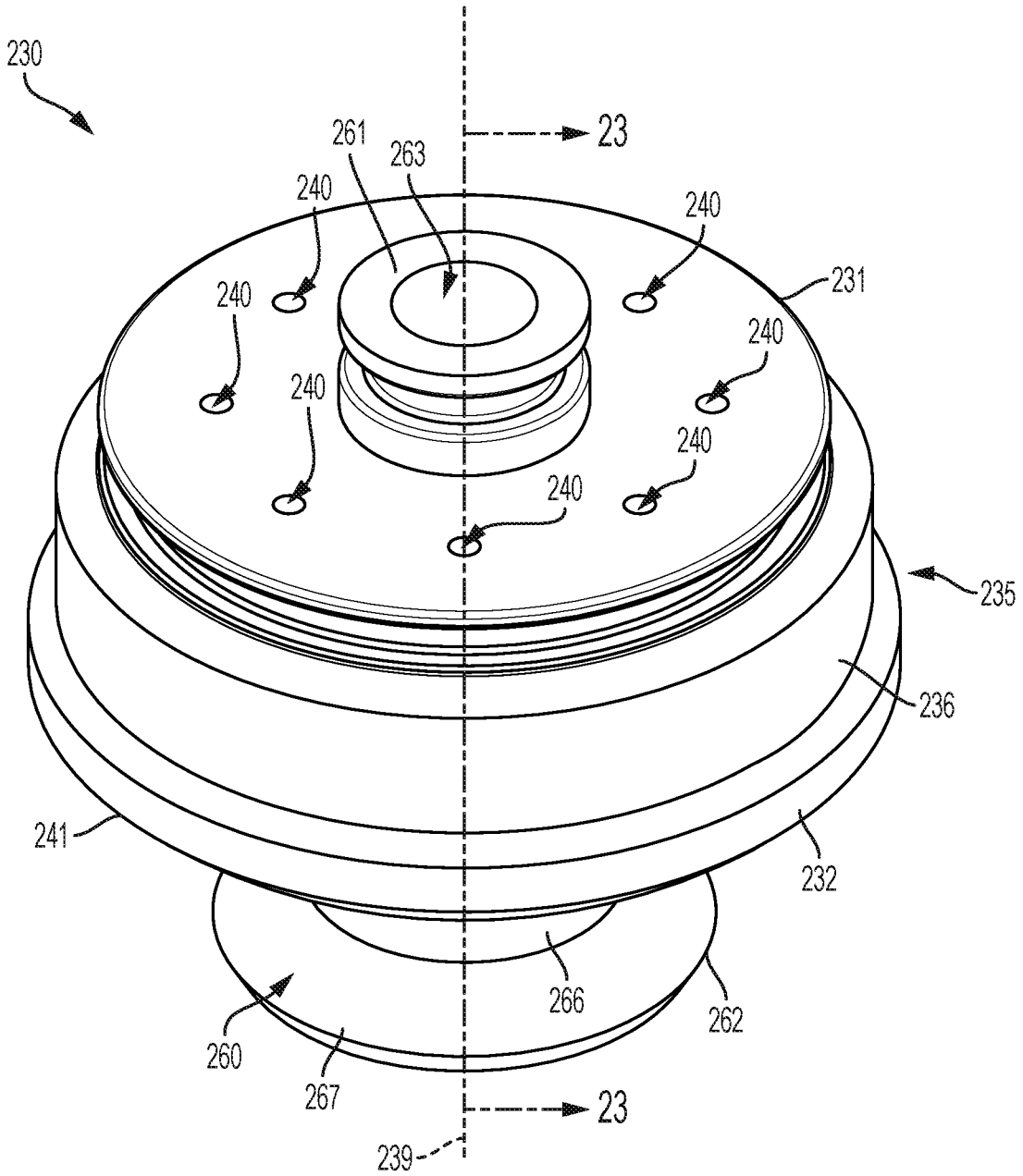
FIG. 19 is a perspective view of an example insert shown in FIG. 12. The components of the insert shown in FIG. 12 are shown assembled in FIG. 19.
Figure 20:
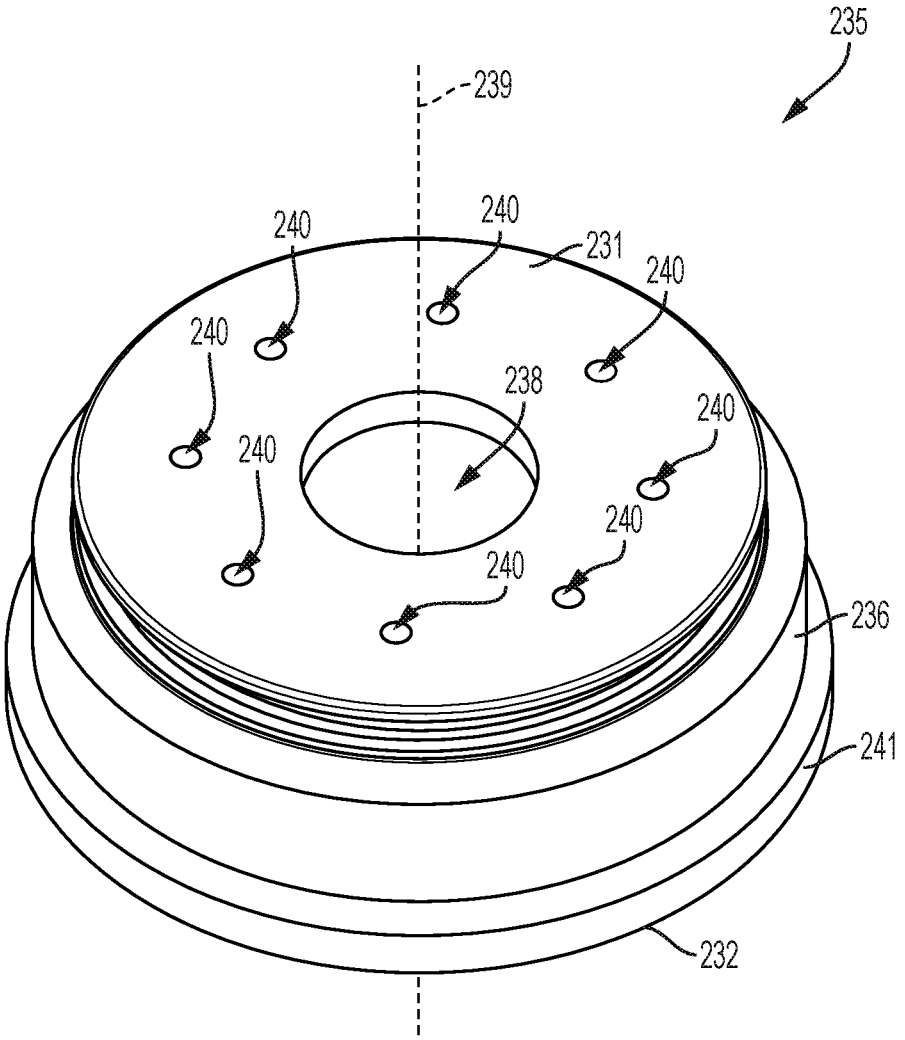
FIG. 20 is a perspective view of a housing of the insert shown in FIG. 12.
Figure 21:
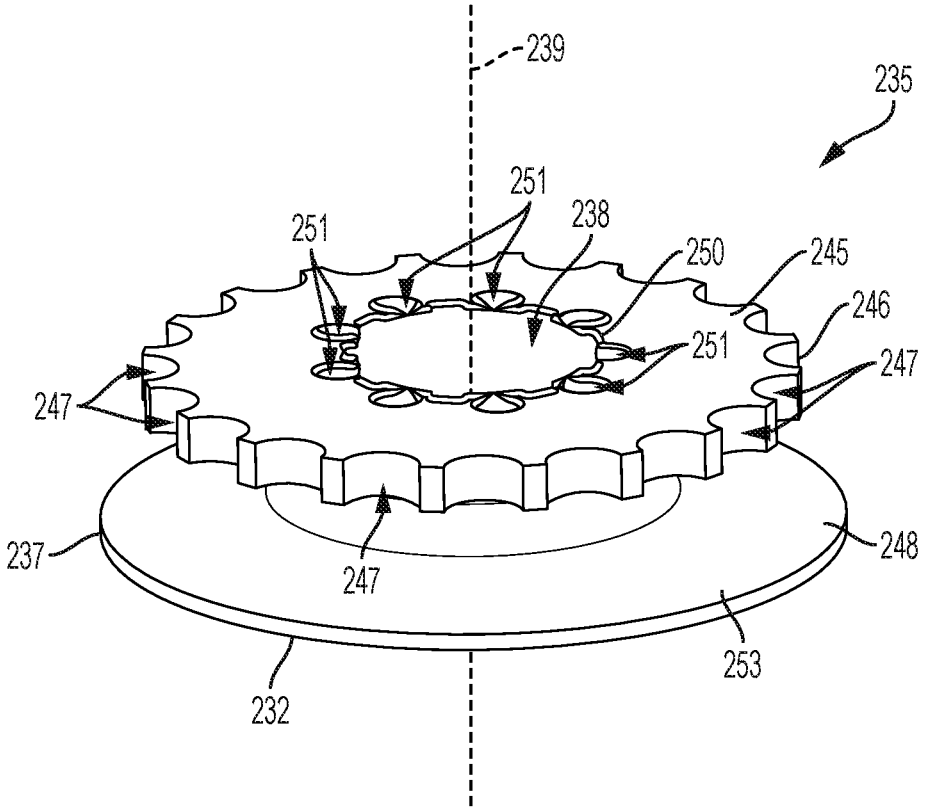
FIG. 21 is a perspective view of a diverter of the insert shown in FIG. 12.
Figure 22:
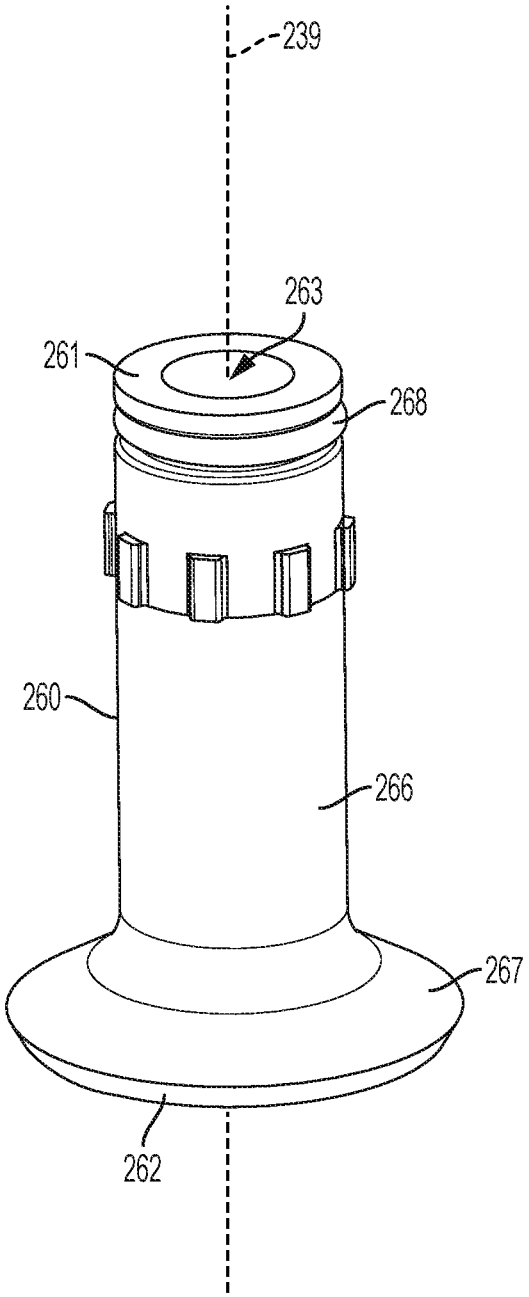
FIG. 22 is a perspective view of a stem of the insert shown in FIG. 12.
Figure 23:
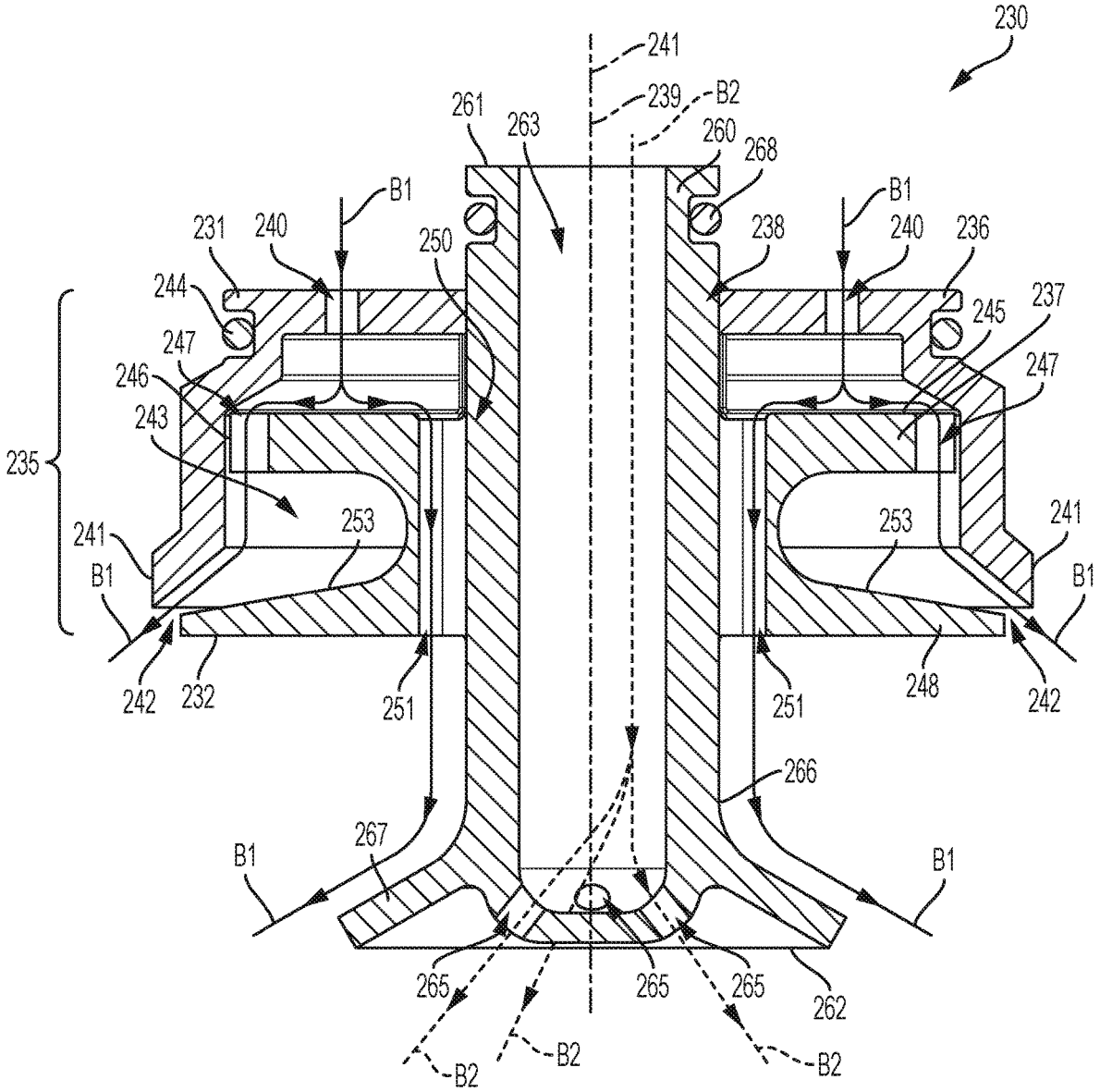
FIG. 23 is a cross sectional view of the insert along line 23-23 of FIG. 19.

FIGS. 19-23 depict an example insert 230 of the nozzle assembly 200. FIG. 19 depicts a perspective view of the insert 230, and FIG. 23 depicts a cross sectional view of the insert 230 taken along line 23-23 in FIG. 19. FIGS. 20-22 depict different portions or components of the insert 230 for clarity. A person having ordinarily skill in the art will recognize that the insert 230 can be separated into any number of portions or components, and in some examples, different portions or components of the insert 230 can be integrally formed as one or more unitary components. Note that FIG. 23 depicts the flow of the first base fluid (shown as solid lines B1) and the second base fluid (shown as dashed lines B2) as the first base fluid and the second base fluid are conveyed through the insert 230.

The insert 230 includes a diffuser 235 with a housing 236 (FIG. 20) and a diverter 237 (FIG. 21) located interior of the housing 236, as seen on FIG. 23. The housing 236 is at the upstream end 231 of the diffuser 235, and the housing 236 is fluidly connected to the base fluid module 120 and receives the first base fluid from the first conduit 121, as described above. The housing 236 is inserted into and received in the chamber 125. A gasket 244 (see FIG. 12) is positioned between the housing 236 and the base fluid module 120 to thereby form a fluid-tight seal there between. The housing 236 includes a plurality of holes 240 through which the first base fluid is conveyed. The cumulative cross sectional area of the holes 240 permits a pressure drop across the housing 236 thereby reducing the volumetric flow rate of the first base fluid being conveyed through the holes 240. Each hole of the plurality of holes 240 is radially spaced equidistantly around a center bore 238 that extends through the housing 236 and the diverter 237 along an axis 239. The axis 239 aligns with the center axis 141 of the additive fluid manifold 140.

The housing 236 has a radially outer edge 241 at a downstream end 232 of the diffuser 235 (FIG. 20). The diverter 237 includes a radial projection 248 with a radially outwardly sloped surface 253 (FIG. 21). As can be best seen in FIG. 23, an outlet 242 of the diffuser 235 is defined between the radially outer edge 241 of the housing 236 and the radial projection 248 of the diverter 237. In the example depicted, the outlet 242 is an annular outlet that extends along the radially outer edge 241.

The diverter 237 further includes a shoulder member 245 positioned between the upstream end 231 and the downstream end 232 of the diffuser 235 such that first base fluid conveyed through the plurality of holes 240 of the housing 236 is dispensed onto the shoulder member 245 (see FIGS. 21 and 23). The shoulder member 245 has a radially outer perimeter 246 with a plurality of cutouts 247 positioned there along. The cutouts 247 in combination with the shoulder member 245 define a first flow path of the first base fluid through the diverter 237. The first flow path is further defined by the radially outwardly sloped surface 253 of the radial projection 248 that is positioned downstream from the cutouts 247. The diverter 237 further includes a radially inner perimeter 250 with a plurality of channels 251 there along. The channels 251 in combination with the shoulder member 245 define a second flow path of the first base fluid through the diverter 237.

The stem 260 of the insert 230 is disposed in the center bore 238 of the diffuser 235 (see FIGS. 22 and 23). In certain examples, the stem 260 is integrally formed with the diverter 237. The stem 260 has a first end 261 configured to be coupled to the second conduit 122 of the base fluid module 120 and directly receive the second base fluid from the second conduit 122. A gasket 268 (see FIG. 12) is positioned between the stem 260 and the second conduit 122 to thereby form a fluid-tight seal there between. A bore 263 extends through the stem 260 between the first end 261 and an opposite second end 262 that is configured to dispense the second base fluid through one or more outlets 265. The second end 262 of the stem 260 extends into and is positioned in the nozzle cavity 273 such that the second base fluid dispenses from the outlet 265 into the nozzle cavity 273, as seen in FIG. 11. The stem 260 has a radially outer surface 266 and a flange 267 that slopes downstream in a radially outwardly direction toward the interior surface 274 of the nozzle 270. The first base fluid, after being dispensed onto the shoulder member 245 is portioned between the first and second flow paths. The base fluid passing through the cutouts 247 enters a chamber 243 defined between the housing 236, the shoulder member 245, and the radial projection 248. The base fluid passing through the channels 251 is conveyed along the outer surface 266 of the stem 260. In certain examples, the stem 260 and the diverter 237 are integrally formed together.

During dispense of the base fluids and the additive fluids, additive fluid(s) are dispensed onto the flange 267 of the stem 260 to thereby mix the additive fluid(s) with the first base fluid upstream from the second base fluid (FIG. 11) (e.g. low ratio additive fluids are dispensed from the upstream outlets 144 additive fluid manifold 140 and onto the flange 267 of the stem 260). In other examples, the additive fluid(s) is dispensed between the flange 267 and the interior surface 274 of the nozzle 270 (FIG. 11).

Referring to FIG. 23 and FIG. 11, the flow the first base fluid (shown as solid lines B1), the second base fluid (shown as dashed lines B2), the additive fluids (shown as dash-dot-dash lines A), and the mixed beverage (shown as dashed lines M) through the beverage dispensing assembly 10 is described in detail below.

The first base fluid B1 is received into the chamber 125 of the base fluid module 120 via the first conduit 121. The first base fluid B1 is conveyed onto the upstream end 231 of the diffuser 235, and the first base fluid B1 is received into the diffuser 235 via the plurality of holes 240 in the housing 236. The first base fluid B1 is dispensed from the plurality of holes 240 onto the shoulder member 245 of the diverter 237. The first base fluid B1 is thereby portioned between the first and second flow paths. The first base fluid B1 conveyed along the first flow path is conveyed through the cutouts 247 and is conveyed onto the radially outwardly sloped surface 253 of the radial projection 248 of the diverter 237 such that the first base fluid B1 is further radially outwardly diffused and dispensed through the annular outlet 242 outwardly to contact the interior surface 274 of the nozzle 270 and into the nozzle cavity 273 where the first base fluid mixes with the additive fluids A. The base fluid washes residual additive fluid from the interior surface 274 of the nozzle 270 between the upstream end 271 and the downstream end 272 of the nozzle 270. The base fluid B1 conveyed along the second flow path through the channels 251 is dispensed onto the radially outer surface 266 of the stem 260 to thereby wash any residual additive fluid accumulated on the radially outer surface 266 and the radial flange 267 of the stem 260. The first base fluid is radially outwardly directed toward the interior surface 274 of the nozzle by the radial flange 267 of the stem 260 such that first base fluid mixes with the additive fluid A.

The second base fluid B2 is received into the second conduit 122 of the base fluid module 120 and the first end 261 of the stem 260. The second base fluid B2 is conveyed through the bore 263 of the stem 260 to the second end 262 of the stem 260 and dispensed from the outlet(s) 265. The outlet(s) 265 of the stem 260 is downstream of the outlet 242 of the diffuser 235 such that the first base fluid B1 dispensed from the diffuser 235 mixes with the additive fluid A before the second base fluid B2 dispensed from the outlet(s) 265 of the stem 260 mixes with the additive fluid A. The additive fluid A and the first base fluid B1 flow or are conveyed together toward the downstream end 272 of the nozzle 270 and the second base fluid B1 mixes into additive fluid A and the first base fluid B1 downstream of the outlet(s) 265 of the stem 260 to thereby form the mixed beverage M. The first base fluid B1, the second base fluid B2, and the additive fluid A are further mixed together by the nozzle fins 276 upstream of the downstream end 272 of the nozzle 270.

In certain examples, an insert is for use with a beverage dispenser having a base fluid module and an additive fluid manifold positioned around the base fluid module. The base fluid module has a chamber, a first conduit through which a first base fluid is conveyed into the chamber, and a second conduit through which a second base fluid is conveyed into the chamber. The additive fluid manifold has an inlet that receives an additive fluid and an outlet that dispenses the additive fluid. The insert includes a diffuser and a stem. The diffuser has a upstream end configured to be inserted into the chamber and to receive the first base fluid, a downstream end with an outlet configured to dispense the first base fluid, and a center bore extending between the upstream end and the downstream end along an axis. The stem is disposed in the center bore and has a first end configured to be coupled to the second conduit to thereby directly receive the second base fluid from the second conduit and an opposite second end with an outlet configured to dispense the second base fluid. The outlet of the diffuser is upstream from the outlet of the stem such that the first base fluid dispensed from the outlet of the diffuser mixes with the additive fluid before the second base fluid dispensed from the outlet of the stem mixes with the additive fluid.

In certain examples, the upstream end of the diffuser has a plurality of holes through which the first base fluid is conveyed such that pressure of the first base fluid is reduced. Each hole in the plurality of holes is radially spaced equidistantly around the center bore. In certain examples, the downstream end of the diffuser has a radially outer edge and the outlet of the diffuser is an annular outlet that extends along the radially outer edge such that the first base fluid radially outwardly dispenses from the annular outlet. The diffuser has a shoulder member positioned between the upstream end and the downstream end of the diffuser, and the shoulder member has an radially outer perimeter and a plurality of cutouts positioned along the radially outer perimeter that extend through the shoulder member. The first base fluid conveyed through the plurality of holes is dispensed onto the shoulder member and is thereby radially outwardly diffused and conveyed through the plurality of cutouts. In certain examples, the shoulder member further comprises a radially outwardly sloped surface positioned downstream from the plurality of cutouts. The first base fluid conveyed through the plurality of cutouts is further radially outwardly diffused by the radially outwardly sloped surface.

In certain examples, the stem has an radially outer surface, and the shoulder member further comprises an radially inner perimeter and a plurality of channels positioned along the radially inner perimeter. The plurality of channels extends through the shoulder member and are configured to dispense the first base fluid onto the radially outer surface of the stem member. The first base fluid dispensed onto the shoulder member is further radially inwardly diffused by the shoulder member such that the first base fluid is conveyed through the plurality of channels and along the radially outer surface of the stem member. The second end of the stem includes a radially outwardly extending flange.

In certain examples, a nozzle assembly is for use with a beverage dispenser having a base fluid module and an additive fluid manifold positioned around the base fluid module. The base fluid module has a chamber, a first conduit through which a first base fluid is conveyed into the chamber, and a second conduit through which a second base fluid is conveyed into the chamber. The additive fluid manifold has an inlet that receives an additive fluid and an outlet that dispenses the additive fluid. The nozzle assembly has a nozzle and an insert with a diffuser and a stem. The nozzle has an upstream end, a downstream end, and a nozzle cavity that extends between the upstream end of the nozzle and the downstream end of the nozzle. The upstream end of the nozzle is configured to be coupled to the additive fluid manifold such that the nozzle is downstream from the base fluid module and the additive fluid manifold. The diffuser has a upstream end configured to be inserted into the chamber and to receive the first base fluid, a downstream end with an outlet configured to dispense the first base fluid into the nozzle cavity, and a center bore extending between the upstream end of the diffuser and the downstream end of the diffuser along an axis. The stem is disposed in the center bore and has first end configured to be coupled to the second conduit to thereby directly receive the second base fluid from the second conduit and an opposite second end with an outlet configured to dispense the second base fluid into the nozzle cavity. The second end of the stem is disposed in the nozzle cavity. The outlet of the diffuser is upstream from the outlet of the stem such that the first base fluid dispensed from the outlet of the diffuser mixes with the additive fluid before the second base fluid dispensed from the outlet of the stem mixes with the additive fluid. The additive fluid and the first base fluid are conveyed together toward the downstream end of the nozzle and the second base fluid mixes with the additive fluid and the first base fluid downstream of the outlet of the stem to thereby form a mixed beverage that is dispensed from the downstream end of the nozzle.

In certain examples, the nozzle has an interior surface that extends between the upstream end of the nozzle and the downstream end of the nozzle. The outlet of the diffuser is configured to dispense the first base fluid onto the interior surface of the nozzle to thereby wash residual additive fluid from the interior surface of the nozzle. The stem has an radially outer surface and the diffuser has a channel configured to dispense the first base fluid onto the radially outer surface of the stem to thereby wash residual additive fluid from the radially outer surface of the stem. The stem has a flange that radially outwardly extends toward the interior surface of the nozzle, and the additive fluid is configured to be dispensed onto the flange. In other examples, the additive fluid is configured to be dispensed between the flange of the stem and the interior surface of the nozzle. In certain examples, the nozzle has a plurality of fins downstream of the stem that further mix the first base fluid, the second base fluid, and the additive fluid that form the mixed beverage.

What is claimed is:

1. An insert for use with a beverage dispenser having a base fluid module and an additive fluid manifold positioned around the base fluid module, the base fluid module having a chamber, a first conduit through which a first base fluid is conveyed to the chamber, and a second conduit through which a second base fluid is conveyed, the additive fluid manifold having an inlet that receives an additive fluid and an outlet that dispenses the additive fluid, the insert comprising:

a diffuser having an upstream end configured to be inserted into the chamber and to receive the first base fluid, a downstream end with an outlet configured to dispense the first base fluid, and a center bore extending between the upstream end and the downstream end along an axis;

a stem disposed in the center bore and having a first end configured to be coupled to the second conduit to thereby receive the second base fluid from the second conduit and an opposite second end with an outlet configured to dispense the second base fluid;

wherein the outlet of the diffuser is upstream from the outlet of the stem such that the first base fluid dispensed from the outlet of the diffuser mixes with the additive fluid before the second base fluid dispensed from the outlet of the stem mixes with the additive fluid;

wherein the upstream end of the diffuser has a plurality of holes through which the first base fluid is conveyed such that pressure of the first base fluid is reduced;

wherein the downstream end of the diffuser has a radially outer edge, and wherein the outlet of the diffuser is an annular outlet that extends along the radially outer edge such that the first base fluid radially outwardly dispenses from the annular outlet;

wherein the diffuser has a shoulder member positioned between the upstream end and the downstream end of the diffuser, the shoulder member has a radially outer perimeter and a plurality of cutouts positioned along the radially outer perimeter and extending through the shoulder member; and wherein the first base fluid conveyed through the plurality of holes is dispensed onto the shoulder member and is thereby radially outwardly diffused and conveyed through the plurality of cutouts.

2. The insert according to claim 1, wherein the shoulder member further comprises a radially outwardly sloped surface positioned downstream from the plurality of cutouts, and wherein the first base fluid conveyed through the plurality of cutouts is further radially outwardly diffused by the radially outwardly sloped surface.

3. The insert according to claim 1, wherein the stem has a radially outer surface;

wherein the shoulder member further comprising a radially inner perimeter and a plurality of channels positioned along the radially inner perimeter, the plurality of channels extending through the shoulder member and being configured to dispense the first base fluid onto the radially outer surface of the stem; and wherein the first base fluid dispensed onto the shoulder member is further radially inwardly diffused by the shoulder member such that the first base fluid is conveyed through the plurality of channels and along the radially outer surface of the stem.

4. The insert according to claim 3, wherein the second end of the stem includes a radially outwardly extending flange.

5. The insert according to claim 1, wherein each hole in the plurality of holes is radially spaced equidistantly around the center bore.

6. A nozzle assembly for use with a beverage dispenser having a base fluid module and an additive fluid manifold positioned around the base fluid module, the base fluid module having a chamber, a first conduit through which a first base fluid is conveyed to the chamber, and a second conduit through which a second base fluid is conveyed, the additive fluid manifold having an inlet that receives an additive fluid and an outlet that dispenses the additive fluid, the nozzle assembly comprising:

a nozzle having an upstream end, a downstream end, and a nozzle cavity that extends between the upstream end and the downstream end, the upstream end configured to be coupled to the additive fluid manifold such that the nozzle is downstream from the base fluid module and the additive fluid manifold;

an insert having:

a diffuser having an upstream end configured to be inserted into the chamber and to receive the first base fluid, a downstream end with an outlet configured to dispense the first base fluid into the nozzle cavity, and a center bore extending between the upstream end and the downstream end along an axis; and a stem disposed in the center bore and having a first end configured to be coupled to the second conduit to thereby receive the second base fluid from the second conduit and an opposite second end with an outlet configured to dispense the second base fluid into the nozzle cavity, the second end is disposed in the nozzle cavity; and wherein the outlet of the diffuser is upstream from the outlet of the stem such that the first base fluid dispensed from the outlet of the diffuser mixes with the additive fluid before the second base fluid dispensed from the outlet of the stem mixes with the additive fluid;

wherein the additive fluid and the first base fluid are conveyed together toward the downstream end of the nozzle and the second base fluid mixes with the additive fluid and the first base fluid downstream of the outlet of the stem to thereby form a mixed beverage that is dispensed from the downstream end of the nozzle;

wherein the nozzle has an interior surface that extends between the upstream end of the nozzle and the downstream end of the nozzle, and wherein the outlet of the diffuser is configured to dispense the first base fluid onto the interior surface of the nozzle to thereby wash residual additive fluid from the interior surface of the nozzle from the upstream end of the nozzle to the downstream end of the nozzle;

wherein the downstream end of the diffuser has a radially outer edge, and wherein the outlet of the diffuser is an annular outlet that extends along the radially outer edge such that the first base fluid radially outwardly dispenses from the annular outlet;

wherein the diffuser has a shoulder member positioned between the upstream end of the diffuser and the downstream end of the diffuser, the shoulder member has a radially outer perimeter and a plurality of cutouts positioned along the radially outer perimeter and extending through the shoulder member; and wherein the first base fluid conveyed through the plurality of holes is dispensed onto the shoulder member and is thereby radially outwardly diffused and conveyed through the plurality of cutouts.

7. The nozzle assembly according to claim 6, wherein the shoulder member further comprises a radially outwardly sloped surface positioned downstream from the plurality of cutouts, and wherein the first base fluid conveyed through the plurality of cutouts is further radially outwardly diffused by the sloped surface.

8. The nozzle assembly according to claim 7, wherein the stem has a radially outer surface; and wherein the shoulder member further comprising a radially inner perimeter and a plurality of channels positioned along the radially inner perimeter, the plurality of channels extending through the shoulder member and being configured to dispense the first base fluid onto the radially outer surface of the stem; and wherein the first base fluid dispensed onto the shoulder member is further radially inwardly diffused by the shoulder member such that the first base fluid is conveyed through the plurality of channels and along the radially outer surface of the stem.

9. An insert for use with a beverage dispenser having a base fluid module and an additive fluid manifold positioned around the base fluid module, the base fluid module having a chamber, a first conduit through which a first base fluid is conveyed into the chamber, and a second conduit through which a second base fluid is conveyed to the chamber, the additive fluid manifold having an inlet that receives an additive fluid and an outlet that dispenses the additive fluid, the insert comprising:

a diffuser having an upstream end configured to be inserted into the chamber and to receive the first base fluid, a downstream end with an outlet configured to dispense the first base fluid, a center bore extending between the upstream end and the downstream end along an axis, and a shoulder member positioned between the upstream end and the downstream end, wherein the shoulder member has a radially outer perimeter and a plurality of cutouts positioned along the radially outer perimeter and extending through the shoulder member; and a stem disposed in the center bore and having a first end configured to be coupled to the second conduit to thereby receive the second base fluid from the second conduit and an opposite second end with an outlet configured to dispense the second base fluid;

wherein the first base fluid dispenses onto the shoulder member and is thereby radially outwardly diffused and conveyed through the plurality of cutouts; and wherein the outlet of the diffuser is upstream from the outlet of the stem such that the first base fluid dispensed from the outlet of the diffuser mixes with the additive fluid before the second base fluid dispensed from the outlet of the stem mixes with the additive fluid.

* * * * *